US006298859B1

(12) United States Patent
Kierulff et al.

(10) Patent No.: US 6,298,859 B1
(45) Date of Patent: Oct. 9, 2001

(54) USE OF A PHENOL OXIDIZING ENZYME IN THE TREATMENT OF TOBACCO

(75) Inventors: Jesper Vallentin Kierulff, Roskilde; Ole Bill Jørgensen, Farum; Tomas Tage Hansen, Allerød, all of (DK); Anthony James Knox, Ontario; Yves De Grandpré, Quebec, both of (CA)

(73) Assignee: Novozymes A/S, Bagsvaerd (DK)

( * ) Notice: Subject to any disclaimer, the term of this patent is extended or adjusted under 35 U.S.C. 154(b) by 0 days.

(21) Appl. No.: 09/349,301

(22) Filed: Jul. 7, 1999

Related U.S. Application Data

(60) Provisional application No. 60/092,134, filed on Jul. 9, 1998.

(30) Foreign Application Priority Data

Jul. 8, 1998 (DK) ..... 1998 00905

(51) Int. Cl.[7] ..... A24B 15/24; A24B 3/12; A24B 1/02

(52) U.S. Cl. ..... 131/297; 131/308; 131/300; 131/309; 131/290

(58) Field of Search ..... 131/290, 297, 131/298, 308, 300, 309, 310

(56) References Cited

U.S. PATENT DOCUMENTS

| | | | | |
|---|---|---|---|---|
| 3,256,888 | * | 6/1966 | De La Burde | 131/141 |
| 3,561,451 | * | 2/1971 | Jacin et al. . | |
| 3,599,645 | | 8/1971 | Johnson . | |
| 3,927,682 | * | 12/1975 | Matsuyama et al. | 131/141 R |
| 4,347,324 | | 8/1982 | Wildman et al. . | |
| 4,887,618 | | 12/1989 | Bernasek et al. . | |
| 4,941,484 | | 7/1990 | Clapp et al. . | |
| 5,311,886 | | 5/1994 | Grandpre et al. . | |
| 5,343,879 | | 9/1994 | Teague . | |
| 5,360,022 | * | 11/1994 | Newton et al. | 131/297 |
| 5,601,097 | * | 2/1997 | Grandpre et al. . | |

FOREIGN PATENT DOCUMENTS

| | | | |
|---|---|---|---|
| 2 069 814 | * | 9/1981 | (GB) . |
| 64 5478 | | 1/1989 | (JP) . |
| WO 92/01046 | | 1/1992 | (WO) . |
| WO 92/16634 | | 10/1992 | (WO) . |
| WO 94/12621 | | 6/1994 | (WO) . |
| WO 96/00290 | | 1/1996 | (WO) . |

OTHER PUBLICATIONS

STN International, File CAPLUS, Accession No. 1972:51073, Doc. No. 77:110753.*
Yano et al., (1971) 113:171–173 (Japanese).*
Schlotzhauer et al., (1992) 22(3) :231–238.*
Coggon et al., (1973) Phytochemistry 12:1947–1955.
Motoda et al., (1970) Ferment. Technol. 48(3):154–160.
Hearing (1987) 142:155–165.
Sharma et al., (1980) Phytochemistry 19:1597–1600.
Lerch (1987) Methods in Enzymology 142:165–169.
Abstract JP 2238885 A, Acc. No. 90–331804.

* cited by examiner

*Primary Examiner*—Stanley S. Silverman
*Assistant Examiner*—Dionne A. Walls
(74) *Attorney, Agent, or Firm*—Jason I. Garbell Esq.; Elias J. Lambiris Esq.

(57) ABSTRACT

A process for preparing tobacco, which process comprises the steps of treating a tobacco material with a phenol oxidising enzyme, such as by extracting tobacco with a solvent to provide an extract and a residue; and treating the extract with a phenol oxidising enzyme such as a laccase. An improved tobacco product having a reduced amount of phenolic compounds. This is an alternative or a supplement to a process in which the phenolic compounds are adsorbed onto the insoluble carrier polyvinylpolypyrrolidone (PVPP). In preferred embodiments, the process includes further steps of removing the oxidised phenolic compound, adding adsorbents such as bentonite; removing and/or inactivating the enzyme; and concentrating the extract. Preferred phenol oxidising enzymes are peroxidases and laccases. The thus treated extract is advantageously re-combined with the tobacco residue and further processed to provide a tobacco article for smoking.

33 Claims, 14 Drawing Sheets

USE OF A PHENOL OXIDIZING ENZYME IN THE TREATMENT OF TOBACCO

CROSS-REFERENCE TO RELATED APPLICATIONS

This application claims priority under 35 U.S.C. 119 of Danish application PA 1998 00905 filed Jul. 8, 1998, and of U.S. Provisional application 60/092,134 filed Jul. 9, 1998, the contents of which are fully incorporated herein by reference.

TECHNICAL FIELD

This invention relates to the preparation and treatment of tobacco. More specifically, the invention relates to such processes in which a tobacco material is treated with a phenol oxidising enzyme to provide an improved tobacco material.

BACKGROUND ART

Processes for improving tobacco quality and varying tobacco flavour are constantly being sought. With these overall goals in mind, efforts are currently spent on i.a. the removal of proteins and phenolic compounds such as polyphenols from tobacco, see e.g. U.S. Pat. No. 5,601,097, which relates to a method for reducing protein and polyphenol content of a tobacco material.

It has been reported that of the polyphenols present in tobacco leaves chlorogenic acid is predominant and that low levels of chlorogenic acid in tobacco leaves leads to low levels of the undesired component catechol in tobacco smoke, Schlotzhauer W.S. (1992), Journal of Analytical and Applied Pyrolysis. Vol 22, page 231–238.

A process for removing phenolic compounds from tobacco which makes use of solid adsorbents such as alumina, is disclosed in U.S. Pat. No. 3,561,451. U.S. Pat. No. 5,601,097 discloses the use of another insoluble adsorbent, viz. polyvinylpolypyrrolidone (PVPP), in such process. However, these methods are disadvantageous in being relatively non-selective.

GB 2069814 relates to a method of changing the structure of tobacco, changing its chemical composition and improving its sensorial feature by submitting tobacco to the action of enzymes selected from oxidoreductases (e.g. monophenol monooxygenase, EC 1.14.18.1), lyases, hydrolases and microorganisms constituting a source of such enzymes.

SUMMARY OF THE INVENTION

In a first aspect, the present invention provides a process for preparing a tobacco product, which process comprises treating a tobacco material with a phenol modifying enzyme, preferably a phenol oxidizing enzyme, and most preferably a polyphenol oxidizing enzyme.

In one aspect, the invention provides a method for reducing the amount of phenolic compounds in a tobacco material, in which method the tobacco material is treated with a phenol oxidising enzyme.

According to the invention, an improved tobacco material having a reduced content of phenolic compounds is achieved by treating a tobacco extract with a phenol oxidising enzyme.

In a further aspect, the invention relates to a process for preparing a tobacco product, which comprises the steps of extracting a tobacco material with a solvent to provide an extract and a tobacco residue; and treating the extract with a phenol oxidising enzyme.

In further aspects, the invention relates to a method for improving the customer compliance, such as, e.g. improving the smoking pleasure of the consumer, e.g. by modifying the chemical composition, flavour, aroma, taste and/or colour thereby increasing the versatility of the tobacco products on the market.

In a further aspect, the invention relates to the use of a phenol oxidising enzyme in the preparation or treatment of tobacco. In one embodiment, the invention relates to the use of a laccase in the treatment of tobacco.

In another aspect, the invention relates to tobacco materials obtainable, in particular obtained, by any of the processes described herein. The invention encompasses the final, ready-for-use tobacco products, as well as any extracts of a tobacco material having been treated by any of the herein claimed processes. These tobacco materials have a reduced amount of phenolic compounds.

DETAILED DISCLOSURE OF THE INVENTION

Figure 1:
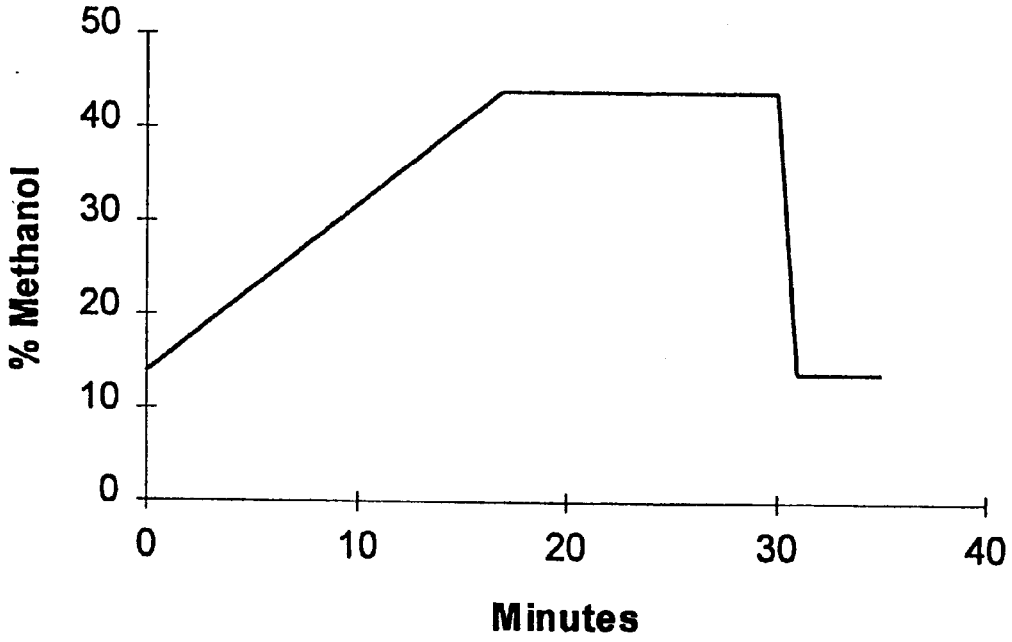
FIG. 1: Binary gradient profile for HPLC analysis of phenols, see Methods and procedures in Examples.
Figure 2:
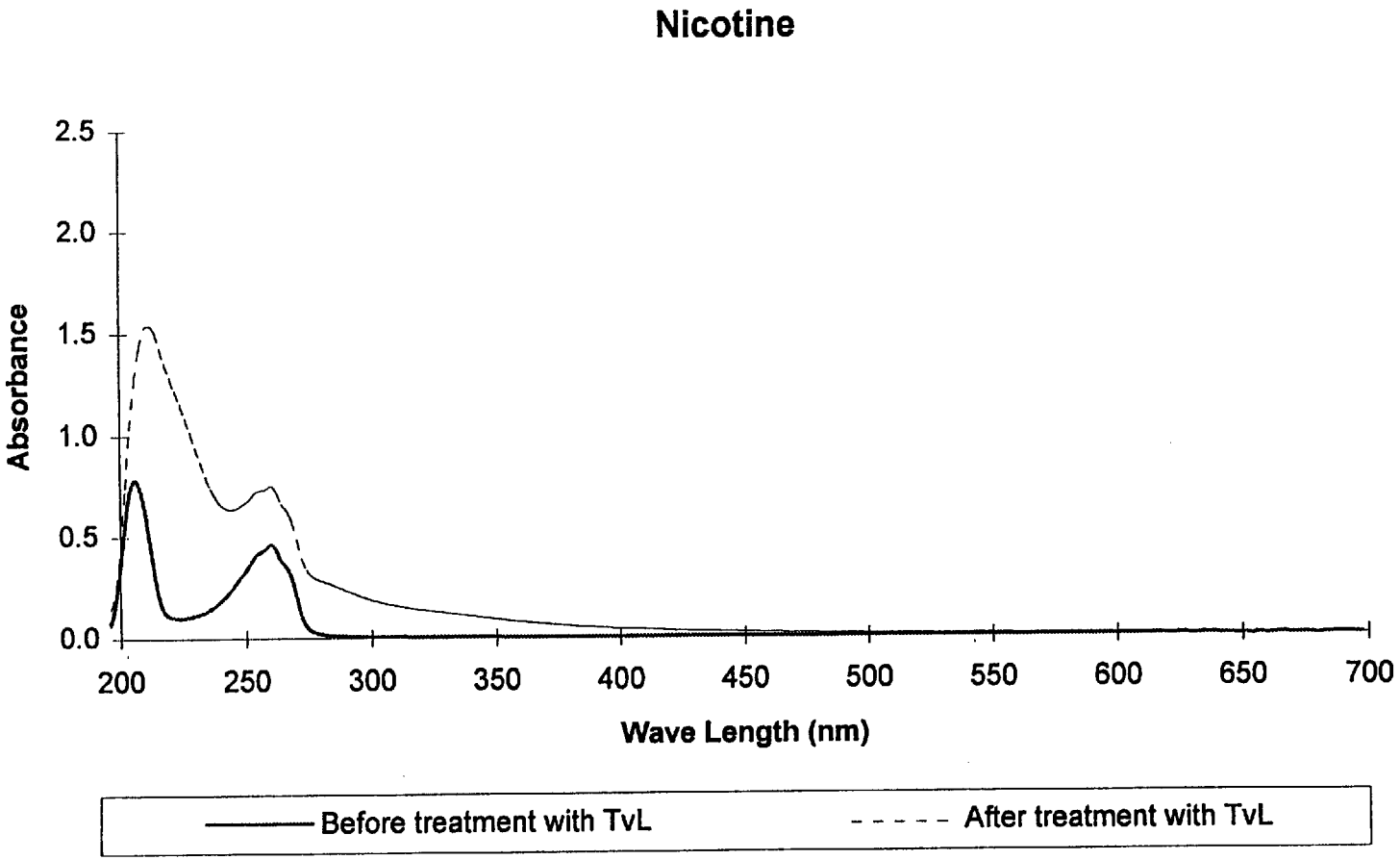
FIG. 2: Spectra of nicotine before and after treatment with laccase, see Example 1.
Figure 3:
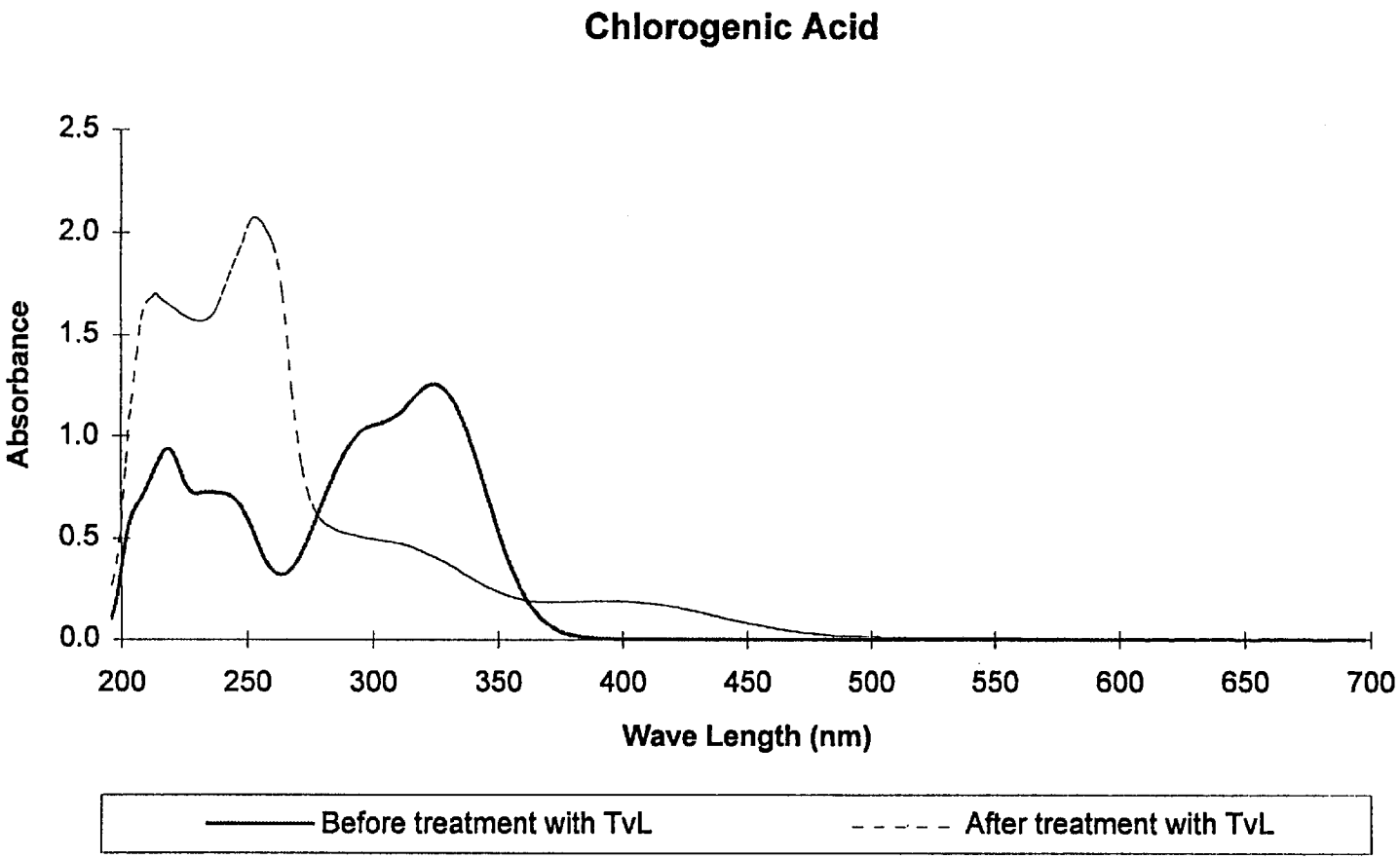
FIG. 3: Spectra of chlorogenic acid before and after treatment with laccase, see Example 1.
Figure 4:
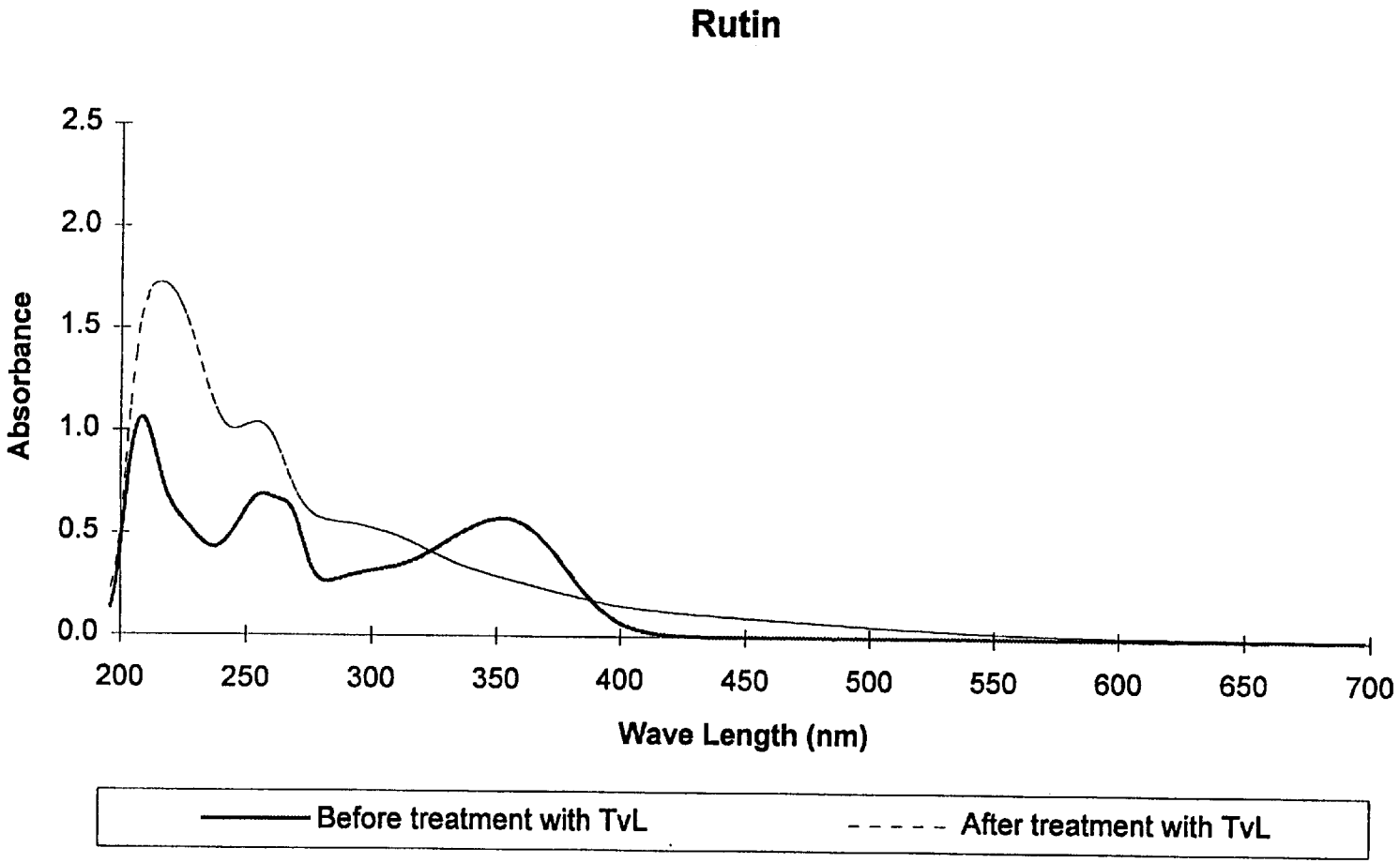
FIG. 4: Spectra of rutin before and after treatment with laccase, see Example 1.
Figure 5:
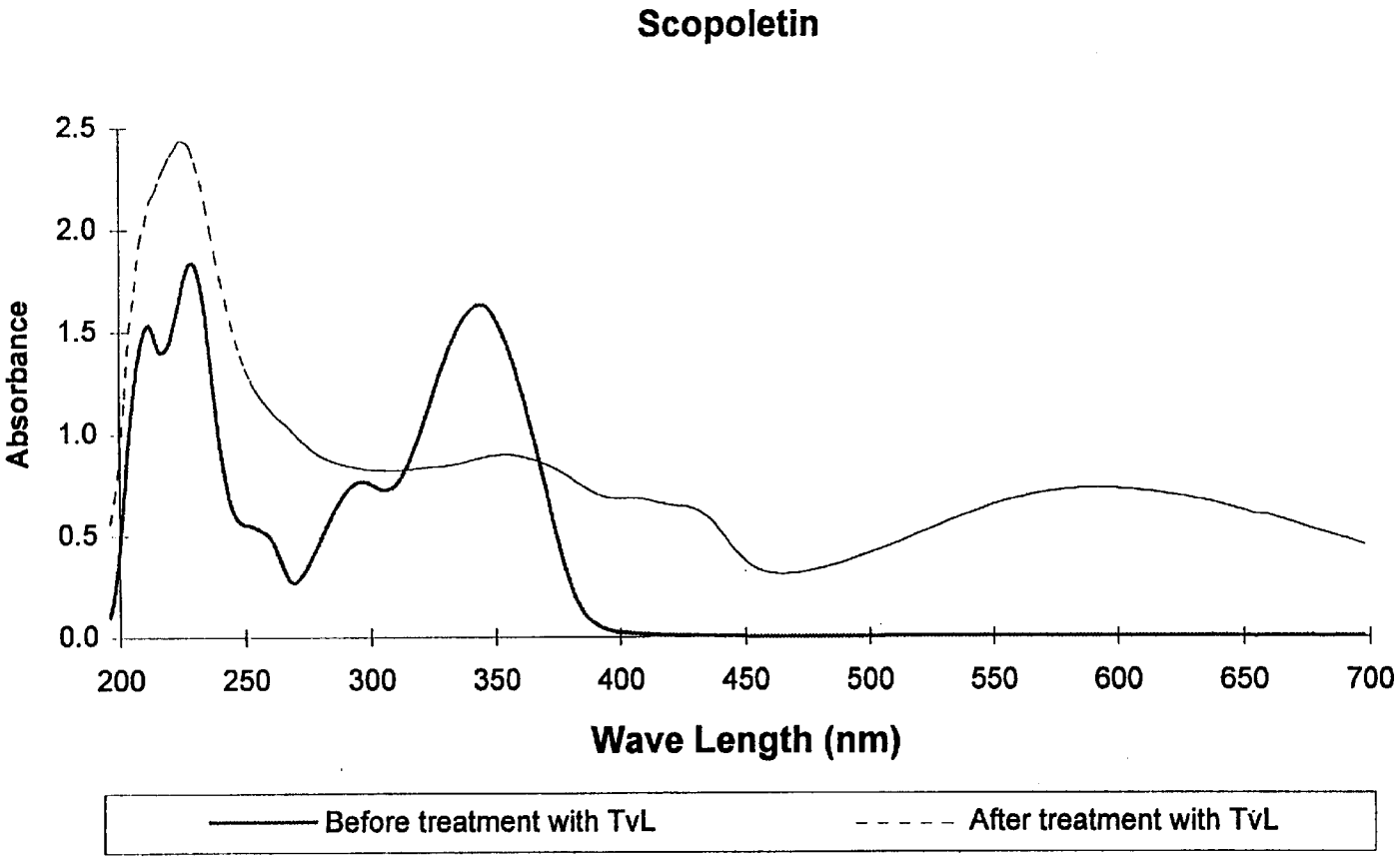
FIG. 5: Spectra of scopoletin before and after treatment with laccase, see Example 1.
Figure 6:
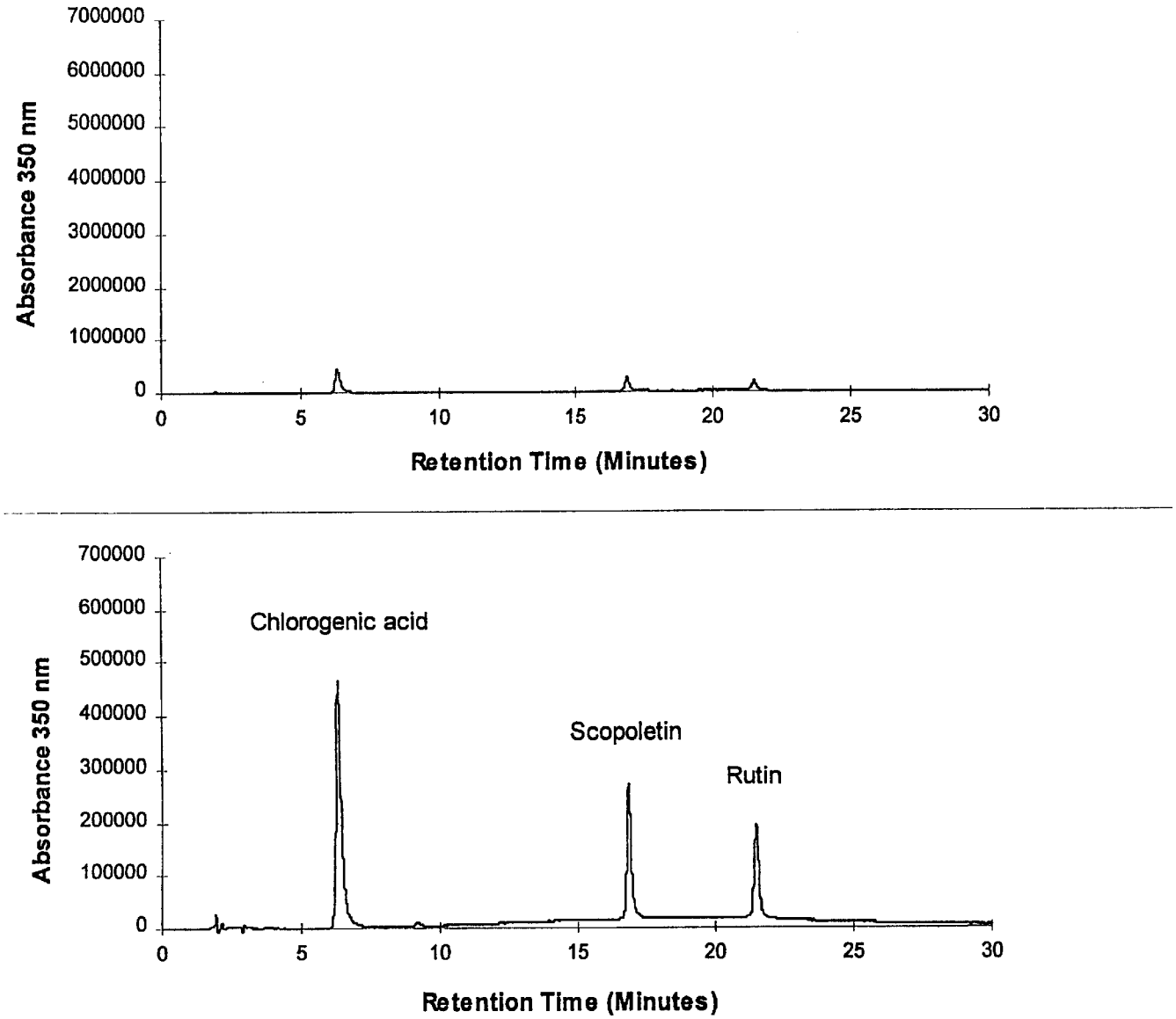
FIG. 6: HPLC chromatogram of mixture of phenol standards: rutin, scopoletin, and chlorogenic acid. The two chromatograms are identical except for the scale, see Example 2.
Figure 7:
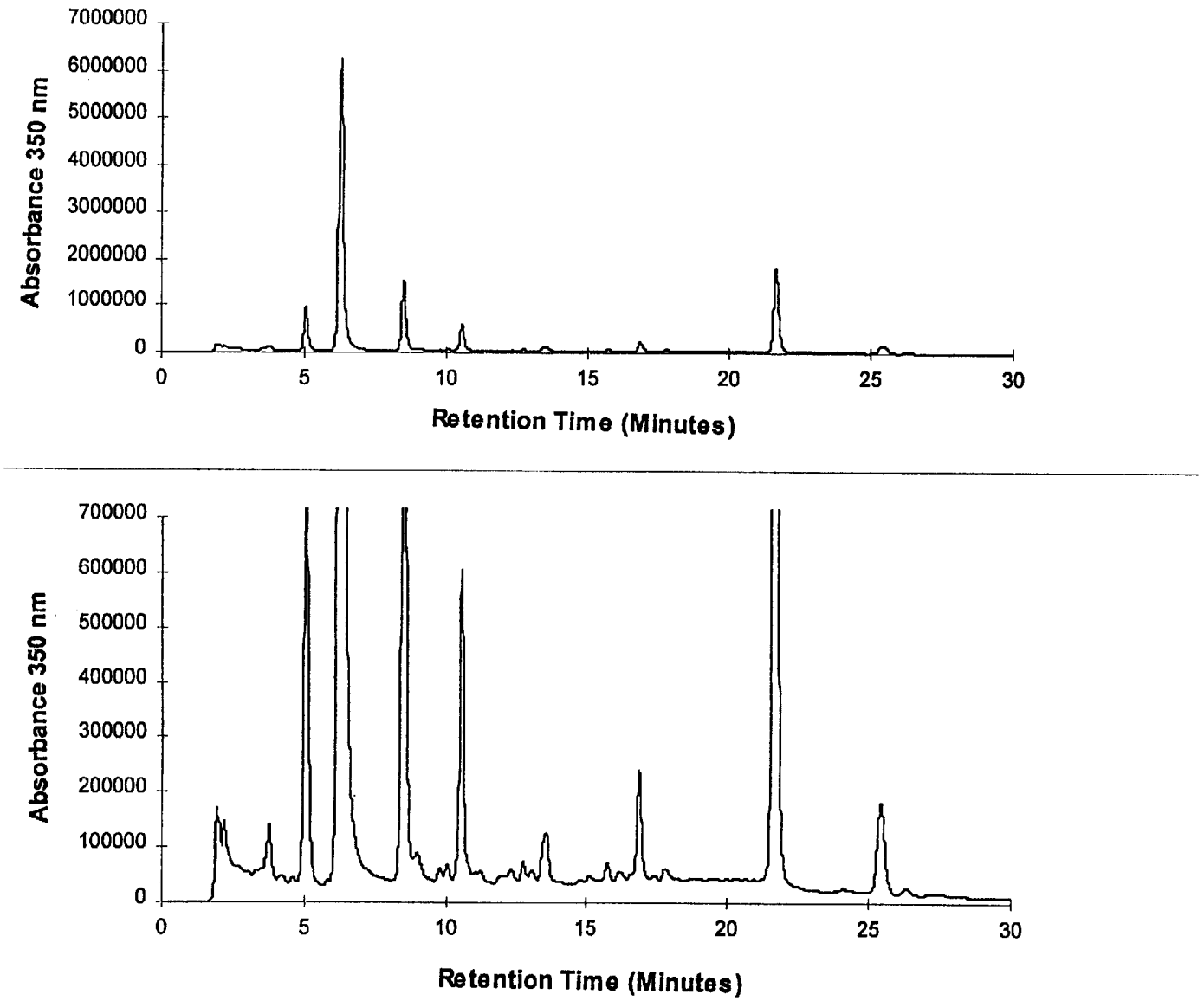
FIG. 7: HPLC chromatogram of tobacco extract. The two chromatograms are identical except for the scale, see Example 2.
Figure 8:
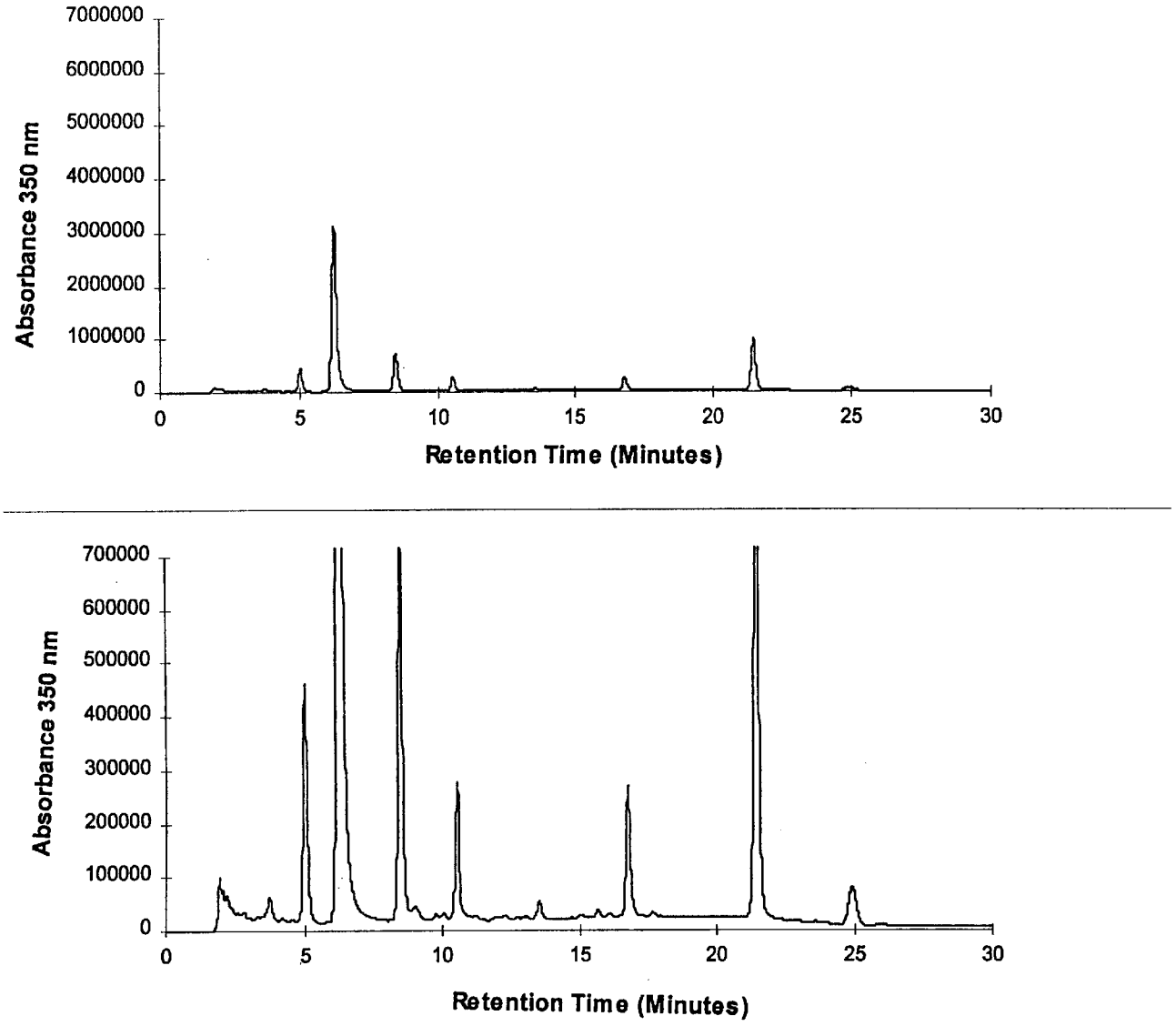
FIG. 8: HPLC chromatogram of tobacco extract spiked with rutin, scopoletin, and chlorogenic acid. The two chromatograms are identical except for the scale, see Example 2.
Figure 9:
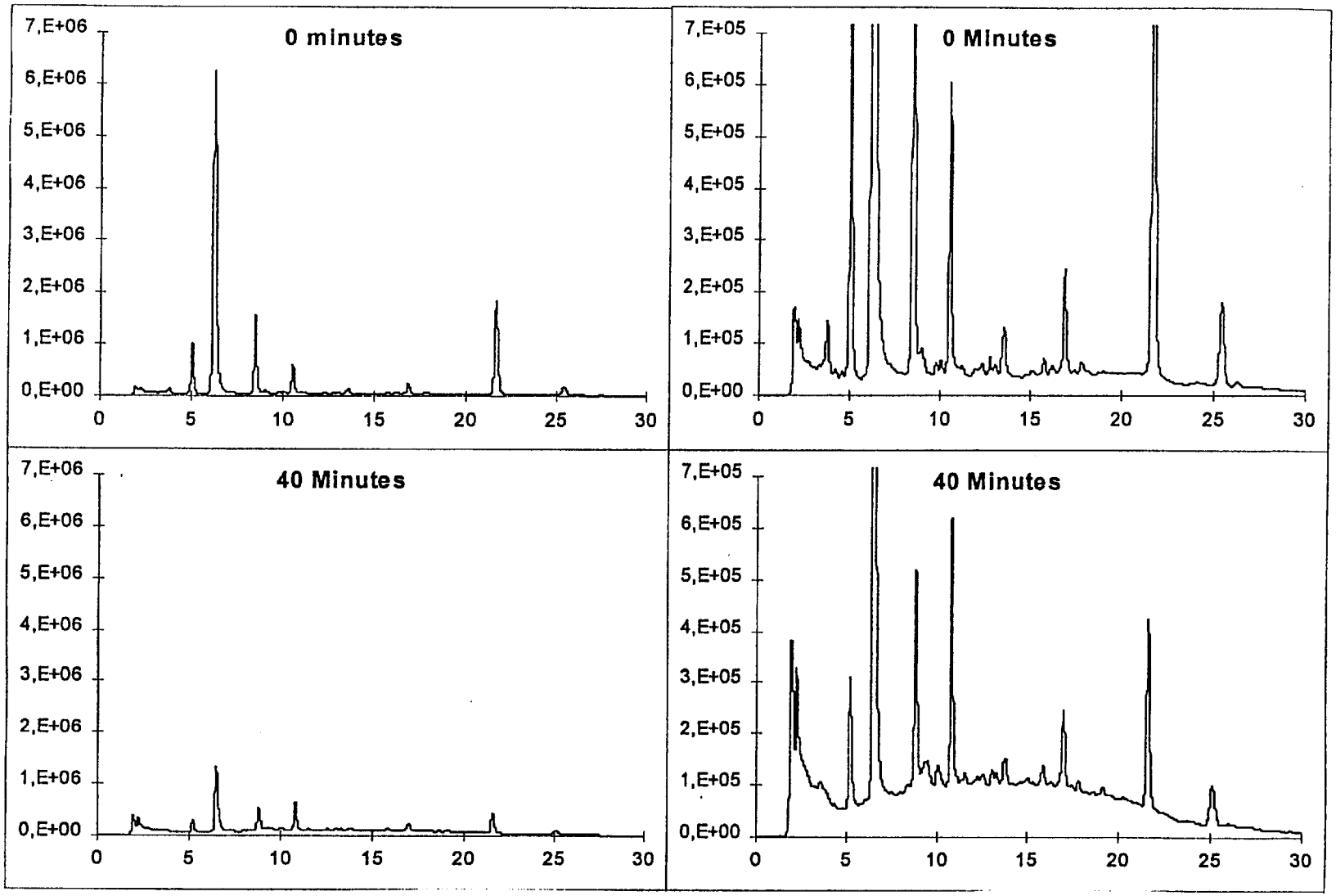
FIG. 9: Series of HPLC chromatograms of samples of tobacco extract as a function of time when treated with 1.6 $\mu$g/ml TvL at pH 5.5 and 55° C. The two sets of chromatograms are identical except for the scale, see Example 2.
Figure 9:
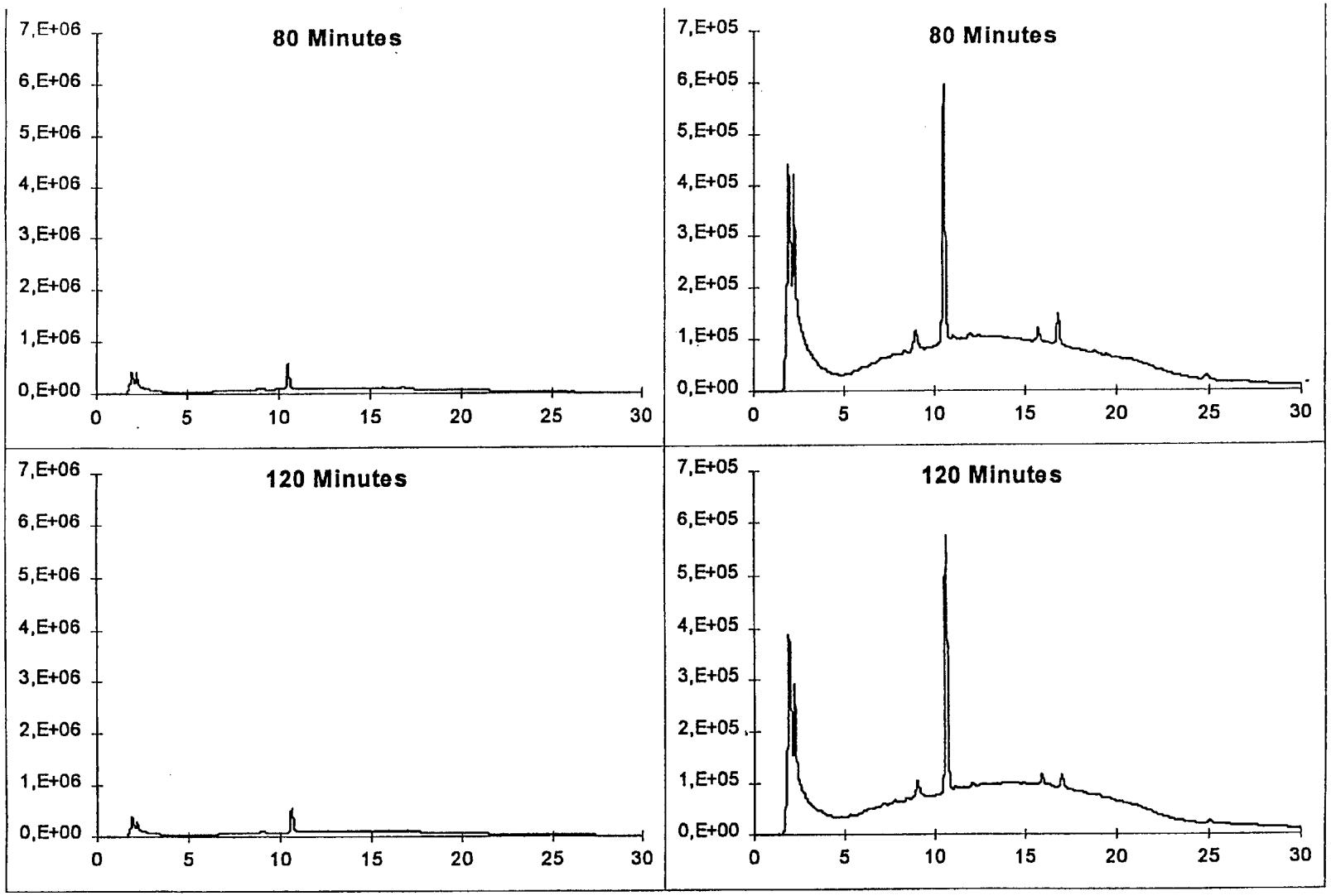

The present invention provides a process for preparing a tobacco product, which process comprises the step of (i) treating a tobacco material with a phenol oxidising enzyme.

The expression "tobacco material" as used herein denotes the tobacco starting material for the various treatments in the present invention, whatever type, source or origin and whatever other kinds of treatments prior to the treatment of the present invention it has been subjected to. Thus, the expression "tobacco material" includes, without limitation, tobacco solids and any solid form of tobacco, such as, e.g., cured tobacco (such as flue-cured tobacco); uncured tobacco (so-called green tobacco); dried, aged, cut, ground, stripped or shredded tobacco; tobacco scrap; expanded tobacco, fermented tobacco; reconstituted tobacco; whatever the source and whatever the grade, as well as any combination of these tobacco materials. Also tobacco blends are included. The tobacco material may be from any parts of the tobacco plant, such as stem, veins, scrap and waste tobacco, cuttings and the like-as well as whole leaf and part thereof. Preferably the tobacco material used as a starting material for present invention is the lamina portion of the tobacco leaf. In a preferred embodiment, the tobacco material is in part or totally composed of cured tobacco. In particular, this expression covers the tobacco raw material entering a tobacco preparation or treatment process. In specific embodiments of the invention, the term tobacco material includes a tobacco extract or a tobacco extraction mixture of any solid form of tobacco; preferably, an extract from cured tobacco is used. The tobacco material used in the process of the invention may be from any tobacco species from which it is desired to make a tobacco product. Of particular interest is tobacco from the subgenus Nicotiana tabacum.

The term "tobacco product" denotes the product resulting from any of the processes of the invention. Included are, without limitation, the final, ready-for-use tobacco products, as well as any extracts of a tobacco material where the extracts have been treated by any of the herein claimed processes. Thus, the term "tobacco product" includes the final products wherein the process according to the invention has been used, in particular the term includes tobacco articles for smoking such as, e.g., cigarettes, cigars, pipe tobacco, but also other kinds of tobacco product such as a tobacco extract and a tobacco for chewing, such as, e.g., chewing tobacco and tobacco chewing gum.

The invention encompasses methods for preparing tobacco products, comprising the step of (i) treating, i.e. contacting, a tobacco material with a phenol modifying enzyme, preferably a phenol oxidizing enzyme, and most preferably a polyphenol oxidizing enzyme. In one embodiment said enzyme is not monophenol monooxygenase (EC 1.14.18.1).

In preferred embodiments, the method of the invention comprises the steps of (ii) extracting a tobacco material with a solvent to provide an extraction mixture; (iii) separating the extraction mixture into a tobacco extract and a tobacco residue; where step (i), i.e. treatment with the phenol oxidising enzyme, is performed during or after step (ii) and before step (iii), or step (i) is performed on the extract after step (iii).

In one embodiment, the invention provides a process for preparing a tobacco product comprising the steps of (ii) extracting a tobacco material with a solvent to provide an extraction mixture; (iii) separating the extraction mixture into a tobacco extract and a tobacco residue; (i) treating the tobacco extract with a phenol oxidising enzyme to produce one or more oxidised phenolic compounds.

The present invention provides a method for reducing the amount of phenolic compounds in tobacco, whereby the soluble phenolic compounds of the tobacco material are extracted into the liquid part of an extraction mixture, thereby facilitating the action of the phenol oxidising enzyme.

The solvent used for the extraction step is preferably an aqueous solvent. However, mixtures of water and organic solvents may also be used to extract phenolic components such as lignin or other hydrophobic compounds, which are not soluble, or only slightly soluble, in water.

By aqueous extraction the water soluble phenolic compounds of the tobacco material will partition into the aqueous extract, together with i.a. nicotine, soluble proteins, sugars, amino acids, pectins, inorganic salts and the surfactants used, if any.

Thus, in general it is preferred that in the process of the invention an aqueous solvent is used which comprises a major amount of water, viz. more than 30%, such as 50%, preferably more than 60%, more preferably more than 75%, still more preferably more than 90% and most preferably more than 95% water, such as more than 99% Water (% means weight percentage) to extract the tobacco material. In one embodiment of the invention, the extraction of the tobacco material is performed with an aqueous solvent composed of 100% water.

Accordingly, the aqueous solvent may comprise additional components other than water, such as, e.g. alcohols such as ethanol or methanol; or other water miscible solvents like dimethylpropylene Urea, N-methylpyrrolidone, acetone, propan-2-ol, propan-1-ol, ethyleneglycol dimethyl ether, ethyleneglycol monomethyl ether, tetrahydrofuran, 1-butanol, 2-butanol, isobutanol, tert-butanol, 1,4-dioxane, morpholine, dimethylformamide, diethylene glycol, dimethyl ether, dimethyl sulfoxide, diethylene glycol monomethyl ether, ethyleneglycol, diethyleneglycol, sulpholane, glycerol or triethanolamine.

The solvent may comprise additional components, including, without limitation, surfactants (whether anionic such as sodium dodecylsulfate and sodium dodecylbenzenesulfonate, cationic or non-ionic); enzymes such as proteolytic enzymes, such as, e.g. Savinase™ from Novo Nordisk A/S, Denmark.

The tobacco material may be extracted with both an organic solvent and an aqueous solvent in two different steps, to extract components which are not soluble or only slightly soluble in water or in aqueous solvents. The extraction of the tobacco material with the aqueous solvent may come before or after the extraction of the tobacco material with the organic solvent. In one embodiment of the invention, the extraction of the tobacco material is performed with an aqueous solvent. Optionally, a further extraction of the tobacco material with an organic solvent is performed before or after the aqueous extraction of the tobacco material. The organic solvent may be pure, water miscible organic solvents, such as alcohols, e.g. ethanol or methanol, or other water miscible solvents like dimethylpropylene Urea, N-methylpyrrolidone, acetone, propan-2-ol, propan-1-ol, ethyleneglycol dimethyl ether, ethyleneglycol monomethyl ether, tetrahydrofuran, 1-butanol, 2-butanol, isobutanol, tert-butanol, 1,4-dioxane, morpholine, dimethylformamide, diethylene glycol dimethyl ether, dimethyl sulfoxide, diethylene glycol monomethyl ether, ethyleneglycol, diethyleneglycol, sulpholane, glycerol, triethanolamine, or pure, organic solvents not miscible with water, such as alcohols, aldehydes, ketones, ethers, alkanes, e.g. tetrahydrofuran (THF), diethylether, methyl isobutyl ketone, pentane, hexane or dioxane, dichloromethane, ethyl acetate, cyclohexane, ligroin, petroleum ether, toluene, xylenes, anisol.

At the stage of treatment with the phenol oxidising enzyme the environment of the extraction mixture or the extract alone, i.e. substantially without the tobacco residue, should be so that the enzyme is capable of being active. Normally, this requires that the enzymatic treatment is performed in an aqueous solvent phase in contrast to an organic solvent phase. If the extraction of the tobacco material is performed using an organic solvent, it is preferred that an aqueous extraction step is performed as a liquid-liquid extraction of the organic extract in order to provide an aqueous phase which in the present context should be understood as being encompassed in the term aqueous extract of the tobacco material. If a mixture of water soluble organic solvents and water is used, the content of organic solvent may be decreased by conventional methods for removal of organic solvents, such as evaporation or freezing (cooling).

In a preferred embodiment a tobacco material is first extracted with an aqueous solvent, preferably water. Subsequently the tobacco residue may be treated with an organic solvent to extract phenolic compounds which are soluble in the organic solvent but not in the aqueous solvent. The resulting organic extract (i.e. the liquid portion separated from the tobacco residue, the tobacco residue being the solid portion of the extraction mixture) may be disregarded or used, preferably following a liquid-liquid extraction to provide and aqueous phase, for combination with a tobacco material, such as e.g. a phenol oxidising enzyme-treated tobacco extract.

According to the invention it is preferred, but not required, that the extraction step be performed under conditions maximising the extraction of soluble phenolic compounds. However even partial extraction is useful for ultimately reducing the concentration of phenolic compounds in the final tobacco product. Some examples of appropriate extraction conditions are listed below. Generally, any of these conditions can be optimised using only routine experimentation by establishing a matrix of conditions and testing different points in the matrix.

Suitable extraction process conditions are e.g. a temperature of 10–80° C., 30–80° C., such as 20–70° C., 30–70° C., 45–70° C., e.g. 35–60° C., such as 40–55° C., about 45–50° C., typically about 45° C.; a pH of 3–10, such as 4–9, 4–8, 5–8, 5–7, e.g. 5–6; an extraction time of 5 minutes to 24 hours, 1–24 hours, such as 5 minutes to 10 hours, 1 minute to 5 hours, 5 minutes to 5 hours, 5 min to 1 hour, 5 min to ½ hour, typically about 15 minutes. The solvent, preferably aqueous, is advantageously added in an amount of 5–200 times the amount of tobacco material (dry weight), such as 5–100 times, more preferably as 5–50 times, most preferably 10–50 times, typically about 40 times. The extraction advantageously takes place under stirring or other kind of mixing of the tobacco material and the solvent.

The surfactant, if any, in the solvent used for extraction may be, without limitation, sodium alkylsulfonates, sodium alkylsulfates, sodium or potassium salts of oarboxylic acids, sodium alkylarylsulfonates, sodium alkylsulfosuccinates and mixtures of any of the foregoing. In particular are considered surfactants having a chain length of between 8 and 12 carbon atoms. In specific embodiments of the invention, the surfactant is one or more of sodium dodecylsulfate, sodium dodecylbenzenesulfonate and sodium dioctylsulfosuccinate (Aerosol OT.™). The surfactant is preferably added to the solvent at a concentration range of 0.01%–5% w/v solution.

According the invention, having provided an extraction mixture, the tobacco residue is preferably separated from the extract either before or after (preferably before) the treatment with a phenol oxidising enzyme. The separation can be performed using any methods, including, without limitation, centrifugation, filtration, sedimentation, decanting or sieving or any combinations thereof. Particularly preferred methods of separation are filtration and centrifugation.

It is preferred that the surfactants, if any, are removed from the extract, said extract is preferably an aqueous extract. This may be done by cooling, e.g. to 4° C. causing the surfactants to precipitate and/or precipitation using e.g. inorganic calcium or magnesium salt followed by e.g. centrifugation.

The term "tobacco residue" as used herein refers to the solid tobacco material resulting from extraction of a "tobacco material" with whatever kind of extraction liquor followed by separation (e.g. by filtration or centrifugation) from the liquid fraction (the "tobacco extract"). The tobacco residue representing the water insoluble portion of tobacco. The tobacco residue may be subjected to further treatment/processing such as drying.

The term "tobacco extract" refers to the liquid fraction (being clarified or not) resulting from extraction of "tobacco material" with whatever kind of extraction liquor followed by separation (e.g. by filtration or centrifugation) from the solid extraction material ("tobacco residue"). Accordingly, the tobacco extract comprises soluble components of tobacco and is substantially free from tobacco solids. The tobacco extract may be subjected to treatment with other additives and/or other processing.

The term "extraction mixture" as used herein refers to a suspension resulting from an extraction of a tobacco material; the suspension comprising a solid fraction and a liquid fraction.

Phenol Oxidising Enzyme, Step (i)

According to the invention, it is essential that the tobacco material, preferably in the form of an aqueous extraction mixture or aqueous extract, is treated with a phenol oxidising enzyme. This step (i) is described in greater detail in the following.

In the present context, the term "phenol oxidising enzyme" includes any oxidoreductase acting on phenols and related substances as donors, preferably with molecular oxygen or hydrogen peroxide as acceptor. The phenol oxidising enzyme of the invention are any enzyme capable of oxidising at least one phenolic compound.

An oxidation is an electron transfer reaction between two reactants: A donor looses an electron (i.e. one or more electrons), an acceptor gains an electron (i.e. one or more electrons); one of the reactants is oxidised (the electron donor), the other reactant is reduced (the acceptor). Enzymes catalysing such reactions are called oxidoreductases.

The phenol oxidising enzyme may be of any origin. The term "phenol oxidising enzyme" encompasses phenol oxidising enzymes derived from prokaryotic or eukaryotic organisms, such as animals, plants or microorganisms (such as e.g. bacteria or fungi—including filamentous fungi and yeast). In one embodiment, the process of the invention utilises a phenol oxidising enzyme derived from tobacco.

The term "derived" means in this context that the enzyme may have been isolated from an organism where it is present natively, i.e. the identity of the amino acid sequence of the enzyme are corresponding to a native enzyme. The term "derived" also means that the enzymes may have been produced recombinantly in a host organism, the recombinant produced enzyme having either an identity corresponding to a native enzyme or having it a modified amino acid sequence, e.g. having one or more amino acids which are deleted, inserted and/or substituted, i.e. a recombinantly produced enzyme which is a mutant and/or a fragment of a native amino acid sequence. Within the meaning of a native enzyme are included natural variants. Furthermore, the term "derived" includes enzymes produced synthetically by e.g. peptide synthesis. The term "derived" also encompasses enzymes which have been modified e.g. by glycosylation, phosphorylation etc., whether in vivo or in vitro.

The term "obtainable" means in this context that the enzyme has an amino acid sequence corresponding to a native enzyme. The term encompasses an enzyme that has been isolated from an organism where it is present natively or one in which it has been expressed recombinantly in the same type of organism or another. With respect to recombinantly produced enzyme the terms "obtainable" and "derived" refers to the identity of the enzyme and not the identity of the host organism in which it is produced recombinantly.

The expression "an enzyme obtainable from an organism", whether an eukaryotic or a prokaryotic organism, denotes an enzyme which has been obtained from the organism where it is produced natively or an enzyme that has been produced recombinantly in a host organism, where the recombinant enzyme has an amino acid sequence corresponding to a native enzyme.

Thus, the term "derived" in the context of "a phenol oxidising enzyme" encompassed phenol oxidising enzymes (such as, e.g. a laccase) obtainable from animals, plants or microorganisms such as bacteria or fungi (including filamentous fungi and yeast) as well as mutants, fragments or variants thereof with phenol oxidising enzymatic activity. One embodiment of the invention comprises use of a phenol oxidising enzyme obtainable from tobacco.

Accordingly, the phenol oxidising enzyme may be obtained from a microorganism by use of any suitable technique. For instance, a phenol oxidising enzyme preparation may be obtained by fermentation of a suitable microorganism and subsequent isolation of a phenol oxidising enzyme containing preparation from the resulting fermented broth or microorganism by methods known in the art. Preferably the phenol oxidising enzyme preparation is obtained by use of recombinant DNA techniques. Such method normally comprises cultivation of a host cell transformed with a recombinant DNA vector comprising a DNA sequence encoding the phenol oxidising enzyme in question and the DNA sequence being operationally linked with an appropriate expression signal such that it is capable of expressing the phenol oxidising enzyme in a culture medium under conditions permitting the expression of the enzyme and recovering the enzyme from the culture. The DNA sequence may also be incorporated into the genome of the host cell. The DNA sequence may be of genomic, cDNA or synthetic origin or any combinations of these, and may be isolated or synthesized in accordance with methods known in the art.

Phenolic Compounds/Phenols:

In the present context, the concept of "phenolic compounds" and "phenols" refers to any compound which comprises at least one phenolic ring structure, i.e. an aromatic ring structure, in particular a benzene ring structure, with at least one OH-substituent at a ring C-atom, whatever other substituents, and whatever the number of condensed benzene rings. This definition, in particular comprises (mono)phenols, as well as polyphenols, such as di-, tri-, tetra-, penta- and hexaphenols.

The term "monophenol" encompasses a compound comprising one hydroxy group attached to an aromatic ring system.

The term di-, tri-, tetra-, -penta and hexaphenols encompasses a compound comprising a total of two, tree, four, five or six hydroxy groups, respectively, and one or more aromatic ring systems, where the hydroxy groups are attached to the same or different aromatic rings.

Figure 11:
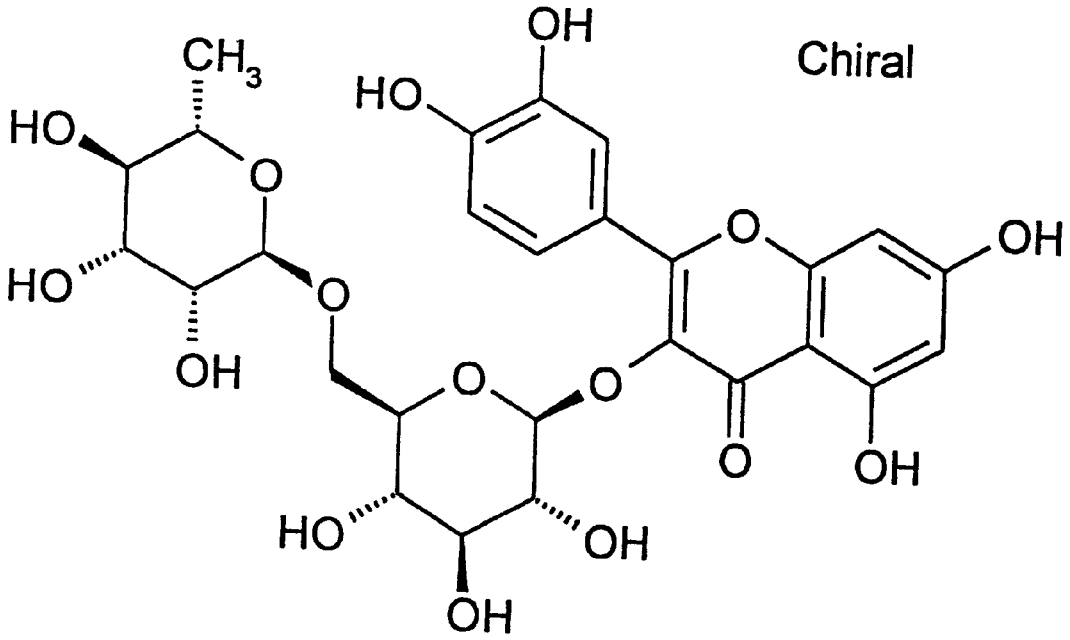
FIG. 11: Chemical structure of Rutin.
Figure 12:
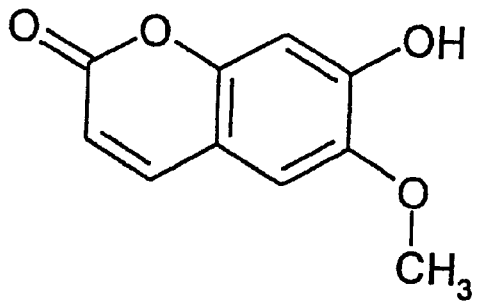
FIG. 12: Chemical structure of Scopoletin.
Figure 13:
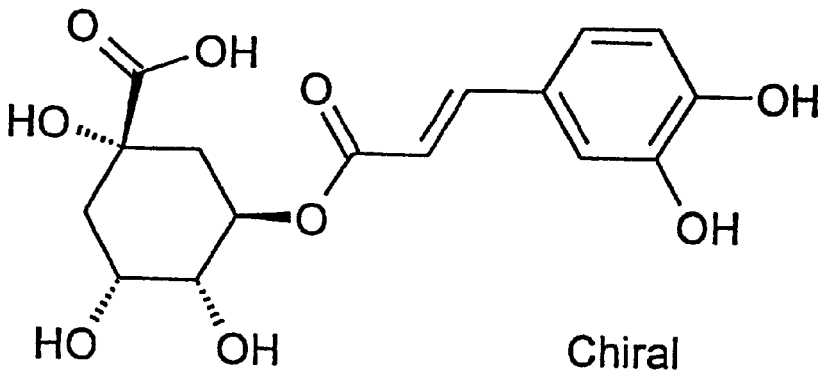
FIG. 13: Chemical structure of Chlorogenic acid.

The term "polyphenol" as used herein refers to a compound comprising 2 or more hydroxy groups attached to one or more aromatic ring systems, as used herein such compounds are also termed "polyhydroxy phenols". The term "polyphenol" as used herein also encompasses a compound comprising one aromatic ring having at least two hydroxy groups attached. The term "polyphenol" as used herein also includes polymeric material based on phenolic monomers, as used herein such compounds are also termed "polymeric phenols". The polymeric material may originate from polymerisation reactions of phenolic compounds Non-limiting examples of phenols relevant to the present invention include flavanoids, such as rutin (also named rutoside), quercetin (also named 2-(3,4-Dihydroxyphenyl)-3,5,7-trihydroxy-4H-1-benzopyran-4-one; and 3,3',4',5,7-pentahydroxyflavone), isoquercitrin (also named 2-(3,4-Dihydroxyphenyl)-3-(β-D-glycofuranosyloxy)-5,7-dihydroxy-4H-benzopyran-4-one; and 3,3',4',5,7-pentahydroxyflavone-3-glycoside; and quercetin-3-glycoside), kaempferol (also named 3,5,7-Trihydroxy-2-(4-hydroxyphenyl)-4H-1-benzopyran-4-one; and 3,4',5,7-tetrahydroxyflavone), robinin (also named 3-[[6-O-Deoxy-α-L-mannopyranosyl)-D-galactopyranosyl]oxy]-7-[(6-deoxy-α-L-mannopyranosyl-)oxy]-5-hydroxy-2-(4-hydroxyphenyl)-4H-1-benzopyran-4-one); coumarins, such as scopoletin (also named 7-Hydroxy-6-methoxy-2H-1-benzopyran-2-one, and 7-hydroxy-6-methoxycoumarin) and scopolin (also named scopoletin-7-glycoside); and caffetannins, such as isomers of cafeoylquinic acid (3-. 4-. 5-o- caffeoylquinic acid). According to the process of the invention, chlorogenic acid (also named 3-o-caffeoylquinic acid and 3-[[3-(3,4-Dihydroxyphenyl)-1-oxo-2-propenyl]oxy]1,4,5-trihydroxycyclohexanecarboxylic acid), rutin and scopoletin is of special interest. The chemical structure of rutin, scopoletin and chlorogenic acid are shown in FIGS. 11–13.

An object of the present invention is to reduce the content of low molecular weight phenolic compounds in tobacco, in particular phenolic compounds that are extractable from tobacco. Of special interest are phenolic compounds extractable in an aqueous solvent such as, e.g., the compounds scopoletin, rutin and chlorogenic acid. The term "extractable phenolic compounds" refers to "soluble phenolic compounds", i.e. phenolic compounds which are capable of being extracted from a tobacco material by means of a solvent. One aspect of the invention relates to water soluble phenolic compounds, i.e. phenolic compounds capable of being extracted from a tobacco material by use of an aqueous solvent, the aqueous solvent being as defined herein, such as, e.g., pure water. One embodiment relates to a process of the invention for reducing the concentration of at least one phenolic compound in a tobacco material wherein said phenolic compound(s) is/are soluble, preferably water soluble, phenolic compound(s).

The term "soluble phenolic compounds" includes low molecular weight phenolic compounds. In specific embodiments of the invention, low molecular weight refers to compounds having a molecular weight of less than about 10,000 Da, preferably less than 5,000 Da, such as less than 2,000 Da, more preferably less than 1,000 Da. In one embodiment of the invention, the term refers to phenolic "monomers", such as, e.g., the low molecular compounds scopoletin, rutin, and chlorogenic acid, that is phenolic compounds which can be polymerised into oligomers or polymers of the phenolic monomer. By polymerisation of the phenolic monomer the molecular weight of the phenolic compounds is increased. In a preferred embodiment of the invention, a polymerisation reaction—caused by the treatment with a phenol oxidising enzyme—proceeds until a high molecular weight phenolic material has been made that will allow separation from the tobacco material, preferably in the form of an extract, by means of e.g. ultrafiltration. In a. preferred embodiment, the polymeric material becomes insoluble and precipitates.

One embodiment of the invention relates to low molecular weight phenolic compounds. In one embodiment, the phenolic compounds of the invention are low molecular weight phenolic compounds soluble in a solvent, preferably an aqueous solvent.

Preferred Phenol oxidising Enzymes

Examples of suitable phenol oxidising enzymes, i.e. enzymes which act on phenolic compounds, such as polyphenols, high molecular weight as well as low molecular weight compounds, include, without limitation, peroxidases (EC 1.11.1.7), laccases (EC 1.10.3.2), bilirubin oxidases (EC 1.3.3.5), monophenol monooxygenases (EC 1.14.18.1) and catechol oxidases (EC 1.10.3.1).

Preferably, the phenol oxidising enzyme is a phenolic oxidase or a peroxidase.

Common to phenolic oxidases is that this group catalyses oxidation reactions in which a donor (in the present context a phenolic compound) is oxidised, molecular oxygen acting as the acceptor.

Peroxidases are characterised by catalysing reactions in which a donor (in the present context a phenolic compound) is oxidised, hydrogen peroxide acting as the acceptor.

The phenolic oxidases or peroxidases of the invention are phenolic oxidases and peroxidases capable of oxidising at least one phenolic compound. To clarify this, the peroxidase of the invention may also be termed a "phenolic peroxidase".

In specific embodiments of the invention, the phenol oxidising enzyme reacts with its substrate by single electron transfer. Laccases are included in this group of enzymes performing 1-electron oxidations. This is in contrast to phenol oxidising enzymes performing 2-electron oxidations.

By the terms "1-electron oxidation" and "single electron transfer is meant that the compound to be oxidised, in this case the phenolic compound, is oxidised by transfer of one electron or one electron charge equivalent, although the compound from an overall view may be further oxidised. In 1-electron oxidation a radical is generated. Thus, the enzymes in consideration will oxidise the phenolic compounds via generation of a radical. With respect to phenolic compounds this means, that initially an electron is abstracted from the phenolic compound generating a phenoxy radical; this is described e.g. by Yaropolov A.I et al. (1994), Applied biochemistry and Biotechnology, 49, page 257–280; and Thurston C. F. (1994), Microbiology, 140, page 19–26.

The radicals, whether a phenoxy radical or an other radical, may be detected by EPR (Electron Paramagnetic Resonance) spectroscopy (also called ESR=Electron Spin Resonance spectroscopy). EPR spectroscopy is a very sensitive and highly specific method of detecting radicals, and it can be used to analyse complex matrixes without extensive sample pre-treatment such as purification and concentration. It is a matter of routine for a person skilled in the art to perform such analysis. A more simple method to detect radical formation is to incubate the phenol oxidising enzyme with a substrate known to form a stable radical which can be detected by simple UV/visible spectroscopy, e.g. ABTS (2,2'-azino-bis(3-ethylbenzothiazoline-6-sulfonic acid) diammonium salt), PPT (phenothiazine-10-propionic acid)) or HEPO (10-(2-hydroxyethyl) phenoxazine).

Examples of enzymes capable of performing 1-electron oxidation are peroxidases (EC 1.11.1.7), laccases (EC 1.10.3.2), bilirubin oxidases (EC 1.3.3.5), and catechol oxidases (EC 1.10.3.1)

Preferred phenolic oxidases are enzymes of classes EC 1.13.-.-; EC 1.14.-.- (such as, e.g., EC 1.14.18.1.) and EC 1.10.3.-, in particular any of the classes EC 1.10.3.1–1.10.3.8, i.e. EC 1.10.3.1, EC 1.10.3.2, EC 1.10.3.3, EC 1.10.3.4, EC 1.10.3.5, EC 1.10.3.6, EC 1.10.3.7 or EC 1.10.3.8.

The enzyme classes (EC) mentioned herein are as defined in Enzyme Nomenclature, 1992, Published for the International Union of Biochemistry and Molecular Biology (IUBMB) by Academic Press, Inc.

In specific embodiments of the invention, the phenolic oxidase is an enzyme corresponding to EC 1.10.3.- which comprises enzymes acting on diphenols and related substances as donors with oxygen as acceptor. Monophenols, however, are also very good substrates. Preferred enzymes of these classes are: Catechol oxidases (EC 1.10.3.1); laccases (alternative name urishiol oxidases, EC 1.10.3.2); and o-aminophenol oxidases (EC 1.10.3.4).

The grouping EC 1.14.18.1 comprises monophenol monooxygenase (alternative name tyrosinase, phenolase, monophenol oxidase, cresolase). In specific embodiments, the phenol oxidising enzyme is for the treatment of a tobacco extract by the process according to the invention is EC 1.14.18.1.

Preferred phenolic oxidases are listed below, included herein are the phenolic oxidases obtainable from the organism in question and any phenol oxidising enzymatically active variants, fragments or mutants thereof. The activities thereof can be measured by any method known in the art.

Laccase (EC 1.10.3.2) enzymes of microbial and plant origin are well known. A suitable microbial laccase enzyme may be derived from plants, bacteria or fungi (including filamentous fungi and yeast) and suitable examples include a laccase derived from a strain of Aspergillus, Neurospora, e.g. N. crassa, Podospora, Botrytis, Collybia, Fomes, Lentinus, Pleurotus, Trametes, e.g., *T. villosa*, previously called *Polyporus pinsitus*, and *T. versicolor*, Rhizoctonia, e.g., *R. solani*, Coprinus, e.g. *C. plicatilis* and *C. cinereus*, Psatyrella, Myceliophthora, e.g. *M. thermophila*, Scytalidium, e.g. *S. thermophilum*, Polyporus, e.g., *P. pinsitus*, Phlebia, e.g., P. radita (WO 92/01046), or Coriolus, e.g., *C. hirsutus* (JP 2-238885), Rhus, e.g. *R. vernicifera*, Pycnoporus, e.g. *P. cinnabarious*, in particular laccases derived from Trametes, Myceliophthora, Scytalidium or Polyporus. In a preferred embodiment, the phenol oxidising enzyme is a laccase derived from tobacco.

A suitable catechol oxidase or monophenol monooxygenases may be derived from animals, plants or microorganism such as bacteria or fungi (including filamentous fungi and yeast). Of particular interest is a catechol oxidase or a monophenol monooxygenase derived from tobacco. Examples of catechol oxidases include a catechol oxidase derived from Solanum melongena (Phytochemistry, 1980, 19(8), 1597–1600) or from tea (Phytochemistry, 1973, 12(8), 1947–1955). Polyphenol oxidase may be derived from molds (Hakko Kogaku Zasshi, 1970, 48(3), 154–160). A mammalian monophenol monooxygenase (tyrosinase) has been described (Methods Enzymol., 1987, 142, 154–165). Other suitable monophenol monooxygenases can be derived from tea leaves (Prikl. Biokhim. Mikrobiol., 1997, 33(1), 53–56), from Chlorella (Ukr. Bot. Zh., 1986, 43(5), 56–59) or from Neurospora crassa (Methods Enzymol., 1987, 142, 165–169).

In a specific embodiment of the invention the phenol oxidising enzyme is not monophenol monooxygenase (EC 1.14.18.1).

Suitable peroxidases may be of class EC 1.11.1.-, e.g. EC 1.11.1.7, EC 1.11.1.13 and EC 1.11.1.14. Preferred peroxidases are enzyme of class EC 1.11.1.7. The group EC 1.11.1.7 comprises peroxidases, catalysing oxidation reactions in which a donor is oxidised, hydrogen peroxide acting as the acceptor.

Preferred peroxidases are listed below, included herein are the peroxidases obtainable from the organism in question and any phenol oxidising enzymatically active variants, fragments or mutants thereof. The activities thereof can be measured by any method known in the art.

The peroxidase may originate from any organism. Preferably, the peroxidase is derived from plants (e.g. horseradish, soybean or tobacco) or microorganisms such as fungi (including filamentous fungi and yeast) or bacteria. Some preferred fungi include strains belonging to the sub-division Deuteromycotina, class Hypho-mycetes, e.g., Fusarium, Humicola, Trichoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Trichoderma resii, Myrothecium verrucana* (IFO 6113), *Verticillium alboatrum, Verticillum dahlie, Arthromyces ramosus* (FERM P-7754), *Caldariomyces fumago, Ulocladium chartarum, Embellisia alli* or *Dreschlera halodes*. Other preferred fungi include strains belonging to the sub-division Basidiomycotina, class Basidiomycetes, e.g. Coprinus, Phanerochaete, Coriolus or Trametes, in particular *Coprinus cinereus f. microsporus* (IFO 8371), *Coprinus macrorhizus, Phanerochaete chrysosporium* (e.g. NA-12) or Trametes (previously called Polyporus), e.g. T. versicolor (e.g. PR4 28-A). Further preferred fungi include strains belonging to the sub-division Zygomycotina, class Mycoraceae, e.g. Rhizopus or Mucor, in particular *Mucor hiemalis*. Some preferred bacteria include strains of the order Actinomycetales, e.g., *Streptomyces spheroides* (ATCC 23965), Strep-tomyces thermoviolaceus (IFO 12382) or *Streptoverticillum verticillium* ssp. verticillium. Other preferred bacteria include *Bacillus pumilus* (ATCC 12905), *Bacillus stearothermophilus, Rhodobacter sphaeroides, Rhodomonas palustri, Streptococcus lactis, Pseudomonas purrocinia* (ATCC 15958) or *Pseudomonas fluorescens* (NRRL B-11). Further preferred bacteria include strains belonging to Myxococcus, e.g., *M. virescens*.

Particularly, a recombinantly produced peroxidase is preferred, e.g., a peroxidase derived from a Coprinus sp., in particular *C. macrorhizus* or *C. cinereus* according to WO 92/16634 and WO 94/12621.

The phenol oxidising enzyme may be purified, viz. only minor amounts of other proteins being present. The expression "other proteins" relate in particular to other enzymes. The term "purified" as used herein refers to removal of other components, particularly other proteins and most particularly other enzymes, that are present in the cell of origin of the phenol oxidising enzyme. Preferably, the enzymes are at least 75% (w/w) pure, more preferably at least 80, 85, 90 or even at least 95% pure. In a still more preferred embodiment the phenol oxidising enzyme is an at least 98% pure enzyme protein preparation.

The term "phenol oxidising enzyme" includes whatever auxiliary compounds that may be necessary for the enzyme's catalytic activity, such as, e.g. an appropriate acceptor or cofactor, which may or may not be naturally present in the reaction system.

The term "phenol oxidising enzyme" also includes components such as stabilisers, activators, preservatives, metal ions, buffers, surfactants, flocculants, chelating agents and dispersants that allow the enzyme to work optimally under the actual conditions. This optimization of the enzyme catalyzed reaction is a matter of routine experimentation for those of ordinary skill in the art. The term "phenol oxidising enzyme" also includes enhancers or mediators which facilitate and/or accelerate the enzymatic reaction, such as, e.g., described by Faure et al. (1995), Applied and environmental Microbiology, 61(3), page 1144–1146 and by Shannon and Pratt (1967), Journal of food Science, 32, page 479–483] as well as by WO 94/12619, WO 95/01426 and WO 96/00179.

Appropriate conditions under which the treatment of the tobacco material, preferably in the form of a tobacco extract, with a phenol oxidising enzyme should occur, are selected paying regard, to the characteristics of the enzyme of choice, some typical conditions being listed below. Generally, of course any of theses condition can be optimized using simple trial-and-error experiments as is usual in the art.

A generally preferred pH is pH 3–11, such as 4–9, 4–8, such as 4–7 or 5–6, such as, e.g. about 5.5. A generally preferred temperature is 10–90° C., such as 10–80° C., preferably 10–70° C., more preferably 15–60° C., 20–60° C., 20–50° C., such as 30–60° C. A generally preferred treatment time is 1 minute to 5 hours, such as 5 minutes to 5 hours, preferably 1 minute to 4 hours, preferably 1 minute to 3 hours, such as 15 minutes to 3 hours, 1 minute to 1 hour, still more preferably 5 to 30 minutes.

The concentration of oxygen as acceptor (relevant to the use of phenolic oxidases only, e.g., laccase) is generally not critical for the reaction as such, except that at high dosages of enzyme the supply of oxygen and thus the concentration of oxygen in the liquor might be rate limiting. However, molecular oxygen from the atmosphere will usually be present in sufficient quantity so that oxygen can be supplied to the process by means of surface aeration or intensive submerse aeration with atmospheric air. Alternatively, pure oxygen can be used for aeration.

If the phenol oxidizing enzyme requires a source of hydrogen peroxide, the source may be hydrogen peroxide or a hydrogen peroxide precursor for in situ production of hydrogen peroxide. Thus in one embodiment of the invention, treatment with peroxidase is performed in the presence of a hydrogen peroxide source. As used herein the term "treatment" in the context of peroxidase" encompasses the presence of a hydrogen peroxide source whenever such a source is required. The term "a hydrogen peroxide source" means a source of hydrogen peroxide being it hydrogen peroxide itself or a hydrogen peroxide precursor for in situ production of hydrogen peroxide.

In following, non-limiting, examples, the treatment with peroxidase is performed in the presence of a hydrogen peroxide source selected from the group consisting of (1) hydrogen peroxide, (2) a hydrogen peroxide precursor, e.g. percarbonate or perborate, (3) a hydrogen peroxide generating enzyme system, e.g. an oxidase and its substrate, e.g. glucose oxidase and glucose, (4) and a peroxycarboxylic acid or a salt thereof. The hydrogen peroxide source may be added at the beginning of or during the process, e.g. in a concentration corresponding to 0.001–25 mM $H_2O_2$. The hydrogen peroxide source may be added continuously to maintain a substantially constant concentration of hydrogen peroxide.

The concentration of hydrogen peroxide as acceptor (relevant to the use of peroxidase only) is generally not critical. However, the selected peroxidase enzyme could be sensitive to hydrogen peroxide (loose activity). Preferably the concentration range of hydrogen peroxide is 0.010–10 mM, such as 0.020–8 mM, 0.05–5 mM, or 0.100–2.5 mM.

The appropriate range may depend on the enzyme in question and can be determined by the person skilled in the art.

Generally, a preferred dosage of the phenol oxidising enzyme is 0.001–1000 mg enzyme protein per litre of the extract (impregnation liquid), such as 0.001–500 mg, 0.001–200 mg, 0.001–100 mg, 0.001–50 mg, preferably 0.01–100 mg, such as 0.01–80 mg, 0.01–50 mg, 0.01–30 mg, 0.01–20, more preferably 0.1–20 mg/litre. Non-limiting examples of dosages of phenol modifying enzyme protein per dry weight of tobacco is 1–1000 μg/g, such as 10–500 μg/g, such as 150 μg/g. These dosage values are preferably based on purified enzyme protein, purified being defined as indicated above.

The phenol oxidising enzyme may be in any form suited for the use in question, such as e.g. in the form of a dry powder or granulate, a non-dusting granulate, a liquid, a stabilized liquid, or a protected enzyme. Granulates may be produced, e.g. as disclosed in U.S. Pat. No. 4,106,991 and U.S. Pat. No. 4,661,452 (both to Novo Industry A/S), and may optionally be coated by methods known in the art. Liquid enzyme preparations may, for instance, be stabilized by adding stabilizers such as a sugar, a sugar alcohol or another polyol, lactic acid or another organic acid according to established methods. Protected enzymes may be prepared according to the method disclosed in EP 238,216.

According to the invention, it is essential that the tobacco material, preferably in the form of an aqueous extract, is treated with a phenol oxidising enzyme.

By "treatment" in the context of a "phenol oxidising enzyme" is meant the addition to a tobacco material, the material being preferably in the form of an aqueous extract, of an effective amount of a phenol oxidising enzyme under conditions which the enzyme exerts its oxidizing activity, i.e. oxidising a phenolic compound from the tobacco material thereby providing an "oxidised phenolic compound".

The term "treatment" in the context of a phenol oxidising enzyme and a tobacco material encompasses contacting a tobacco material with a phenol oxidising enzyme under conditions which result in a reduction in the concentration of at least one phenolic compound in said material. By "contact" in the context of "contacting a tobacco material with a phenol oxidising enzyme" is meant the addition of a phenol oxidising enzyme to a tobacco material.

Within the scope of the invention is a process for preparing a tobacco product, which process comprises (a) extracting a tobacco material with a solvent to provide an extraction mixture; and (b) separating the extraction mixture into a tobacco extract and a tobacco residue, contacting the tobacco extract with a phenol oxidising enzyme, such as a phenolic oxidase or a peroxidase, under conditions which result in a reduction in the concentration of at least one phenolic compound in said extract. In one embodiment the contacting is performed during or after said extracting and before the separating.

By the term "effective amount" is to be understood an amount of enzyme which is effective in order to provide a tobacco product having a reduced content of a specific phenolic compound, such as an at least 10% reduction, at least 20%, at least 50%, at least 75%, preferably 95%, or even more preferred at least a 98% reduction, such as a 100% reduction of the specific compound. The %-reduction being calculated as indicated below. The term "a specific phenolic compound" encompasses that by the enzyme treatment of the tobacco material there is obtained a reduction in the amount of at a phenolic compound in said material. There may be a variation i the %-reduction for different phenolic compounds. In preferred embodiments of the invention, the reduction of each phenolic compound corresponds to a %-reduction as indicated above. According to the invention, the enzyme treatment of a tobacco material provides a reduction on the concentration of at least one phenolic compound of said tobacco material, such as reduction on the concentration of at least two phenolic compounds or at least tree phenolic compounds in said tobacco material.

In specific embodiments, the tobacco product obtained by a process according to the invention has a reduced content of at least one of chlorogenic acid, rutin or scopoletin, such as an at least 5% reduction, such as at least 10%, at least 20%, at least 40%, at least 50%, at least 60%, at least 75%, at least 80%, at least 90%, preferably at least a 95%, or even more preferred at least 98% a reduction, such as a 100% reduction in the content of chlorogenic acid, rutin or scopoletin, respectively, as compared to the tobacco material before the treatment. The reduction may be monitored e.g. by HPLC analyses of extracts of the tobacco material before and after treatment with a phenol oxidising enzyme. The %-reduction being calculated as indicated below.

In further embodiments, by the process according to the invention—comprising 1) treatment with a phenol oxidising enzyme to provide an oxidation of at least one phenolic compound in said tobacco material, 2) further comprising the step of separating the oxidised phenolic compounds) from the tobacco material—leads to a tobacco product having a reduced total content of phenolic compound. The reduction being e.g. at least a 5% reduction, at least 10%, at least 20%, at least 40%, at least 50%, at least 60%, at least 75%, at least a 80% reduction; such as a reduction in the range 2%–95%, 5%–80%, 5%–50%, 5%–40%, 5%–30%.

Several methods of analysing for phenolic compounds are known in the art. Some methods measures total phenolic content, while others differentiates between phenolic compounds having different molecular weight, and still others allow separation of individual (low molecular weight) phenolic compounds followed by quantification. Preferably is used an analysing method that allows separation of individual phenolic compounds followed by quantification, e.g. HPLC (High Pressure Liquid Chromatography, also named High Performance Liquid Chromatography), GLC (Gas Liquid Chromatography also called Gas Chromatography) or capillary electrophoresis, but other methods may be used as well. Such methods can by the person skilled in the art be designed, performed and optimized to fit and meet the requirements of the analytical problem in question, i.e. to analyse the phenolic compound(s) in question.

In general, there are two means of following the development in the content of the compounds in question; 1) absolute quantification by means of comparison of the resulting signal (e.g. peak area or peak height or similar) with the signal produced from a standard of know absolute concentration, or 2) relative quantification by comparing the size of the resulting signal produced by the individual phenolic compound, before, during, and after the enzyme treatment, and use the development in the size of the signal to calculate the relative (that is the percentage) reduction of the individual phenolic compounds. The size of the resulting signal will normally correlate with the concentration observed in the sample if an appropriate range of concentration is examined (normally, this means that the concentration range used is in the range in which the signal correlates linearly with the concentration). Consequently, if the method of analysis allows separation of individual phenolic compounds and provided that the signal correlates with the concentration, it will be possible to calculate the efficiency of the enzyme treatment without using any standards, by comparing the size of the signal before and after the treatment to calculate % remaining phenolic compound and/or % phenolic compound removed (% reduction) using the following equations:

$$\%\ \text{Remaining} = \frac{\text{Size of signal after treatment}}{\text{Size of signal before treatment}} \times 100\ \%$$

$$\%\ \text{Reduction} = \frac{\text{Size of signal before treatment} - \text{Size of signal after treatment}}{\text{Size of signal before treatment}} \times 100$$

In specific embodiments, the process of the invention, comprising treatment with a phenol oxidising enzyme, provides a tobacco material which by HPLC analysis of the tobacco material before and after the enzyme treatment shows reduction in a signal (peaks), corresponding to a phenolic compound, monitored by HPLC analyses. This is preferably a %-reduction of at least 5%, such as at least 10%, at least 20%, at least 40%, at least 50%, at least 60%, at least 75%, at least 80%, at least 90%, preferably at least 95%, or even more preferred least 98%, such as 100%. This may be measured as described herein in the section "Examples". In a preferred embodiment, there is a reduction in at least one signal (i.e. at least one phenolic compound), such as at least 2 signals (i.e. at least two phenolic compounds).

In further aspect the invention relates to a process for reducing the concentration of at least one phenolic compound in a tobacco material, which process comprising treating tobacco material with a phenol modifying enzyme, said tobacco material preferably being in the form of an extract of a tobacco material. Preferably, the modification of the enzyme facilitates the removal of the modified phenolic compound, thereby leading to a reduction in the total content of phenolic compounds in the tobacco material. In one embodiment of the invention the phenol modifying enzyme is a phenol oxidising enzyme.

(iv) Separation of Oxidized Phenolic Compound

After the treatment with a phenol oxidising enzyme, step (i), the process according to the invention preferably comprises the step of (iv) separating the oxidized phenolic compound from the tobacco extract. The term "oxidised phenolic compound" encompasses the phenolic compounds which has been oxidised by the treatment with an enzyme according to the invention. The oxidised phenolic compound is preferably in a polymerised form. The oxidised phenolic compound is preferably in one or more of the forms precipitate, haze, dissolved or dispersed. Thus, a precipitate/haze may be generated during the treatment of tobacco extract with a phenol oxidising enzyme. The precipitate comprising the oxidised polymerised phenolic compounds, is preferably separated from the extract.

The precipitate/haze may be removed by any suitable method in the art, including, without limitation, centrifugation, filtration, ultrafiltration, sedimentation, flocculation, reverse osmosis, decanting or sieving. A combination of different methods and/or a repetition of one or more of the methods may also be used. In a specific embodiment of the invention the adsorption is performed with an adsorption means selected from the group consisting of Fuller's earth minerals such as attapulgite or bentonite, hydroxyapatite (tri-calcium phosphate), PVPP, an anion exchange resin, a cation exchange resin, a hydrophobic resin and activated carbon, or any combination thereof. In one embodiment, the process of the invention includes an adsorption step using, first, bentonite, which is followed by an adsorption step using hydroxy apatite (tri-calcium phopshate). Preferably, ultrafiltration is used, in particular for the dissolved or dispersed polymerised oxidised phenolic compounds.

Optionally, the extract is also treated with an insoluble adsorbent, step (vii), preferably a water insoluble adsorbent. Examples of suitable insoluble adsorbents are hydroxyapatite (tri-calciumphophate) and Fuller's earth minerals such as attapulgite or bentonite. This step serves i.a. to remove soluble polypeptides such as proteins including the enzyme, as well as the polymerized phenolic reaction products of step (i). Preferred insoluble adsorbents are bentonite and hydroxylapatite. The adsorbent can be simply suspended in the extract and subsequently separated by e.g. centrifugation, or it can be contained in a column through which the extract flows.

In specific embodiment the extract is treated with polyvinylpolypyrrolidone (PVPP), step (viii). In other embodiments, the treatment with PVPP is omitted.

By treatment in the context of an adsorbent is meant contacting the extract with an adsorbent under conditions facilitating the adsorbtions, followed by the removal of the adsorbent if desired, the adsorbent being preferably an insoluble adsorbent.

One embodiment of the invention relates to the removal of the modified phenolic compounds, the modified phenolic compound provided by treatment with a phenol modifying enzyme as described herein.

In one embodiment of the invention, the enzyme treatment is performed on an extraction mixture. The oxidised phenolic compounds is preferably separated from the extraction mixture, i.e. from tobacco solids ("tobacco residue") as well as the liquid part ("tobacco extract"). This separation may be done by first making a crude separation, e.g. by filtration, that allows the solvent and the oxidised phenolic compounds, which may have formed a precipitate and/or haze, to be separated from the tobacco residue. The choice of method for separation is not critical as long as it allow to distinguish between the tobacco residue suspended in the solvent and the solid precipitate/haze that may have been formed by the oxidised phenolic compounds. The thus separated tobacco residue may be rinsed with water to remove additional oxidised phenolic compounds. The filtrate containing the oxidised phenolic compounds which will probably be present as a fine precipitate, and/or haze, and/or as oxidised phenolic compounds in colloidal solution, may be further processed to separate the oxidised phenolic compounds from the extract. This may be done by means of separation such as filtration, centrifugation, ultra filtration, sedimentation etc. as already described herein.

Inactivating and/or Removal of the Enzyme, Step (v)

Following the treatment with phenol oxidising enzyme, the phenol oxidising enzyme, may optionally be inactivated (e.g., by heating to 100° C. and holding this temperature for, e.g., 10 minutes) and/or removed (e.g., by adsorption or precipitation) by any method suitable for inactivation and/or denaturation and/or precipitation and/or removing the particular enzyme in question). The enzyme may be removed together with the precipitated oxidised phenolic compounds, e.g. by adsorption as described for the removal of the oxidised phenolic compounds. In one embodiment of the invention, ultrafiltration is used for removal of the enzyme. Accordingly, the process of the invention in one embodiment comprises the step of inactivating and/or removing the phenol oxidising enzyme from an enzyme treated tobacco material, said tobacco material being, e.g., in the form of a tobacco extract.

In one embodiment, the enzyme used is immobilised and is easily and quantitatively removed, thereby facilitating the product of the invention to be substantially free from the added phenol oxidising enzyme. Common techniques for immobilisation of enzymes are known in the art and include, without limitation, adsorption, covalent bonding and cross-linking onto carrier materials such as ion-exchange resins, artificial polymers, e.g. nylon, polyethylene imine, polystyrene, methacrylate, naturally occurring biopolymers and derivatives thereof, e.g. chitin, chitosan, glyceryl chitosan, cellulose and derivatives thereof, e.g., DEAE-cellulose, (ground/crushed-) egg shells, inorganic materials, e.g. $SiO_2$, glass beads, bentonite, and other insoluble supports, as well as encapsulation in gels or (micro)capsules prepared from polymers. Typically, immobilised enzymes exhibit little or even no leakage of enzyme during use, resulting in a liquid fraction with no or very little enzyme when separated from the immobilised enzyme particles. A very specific and sensitive method for quantification of the amount of leaked enzyme is the use of immobilized enzyme which has been radioactively labelled prior to immobilisation, e.g. by methylation of lysine residues in the protein backbone by means of reaction with $^{14}C$-formaldehyde. Some examples of immobilisation of enzymes are disclosed in Pialis, P. et al. (1996), Biotechnology and Bioengineering, 51, page 141–147; Bhosale S. H. et al. (1996), Microbiological Reviews, 60(2), page 280–300; Spagna G. et al. (1993), Journal of Chemical Technology and Biotechnology, 57, page 379–385; Spagna G. et al. (1998), Process Biochemistry, 33(1), page 57–62; Martino A. et al. (1996), Process Biochemistry, 31(3), page 281–285; and Martino A. et al. (1996), Process Biochemistry, 31(3), page 287–293.

If the enzyme treatment of a tobacco extract is performed using immobilised enzymes, a preferred way of separating the oxidised phenolic compounds, which may have produced a precipitate/haze, from the immobilised enzyme solids, as well as the solvent, is to first make a crude separation, e.g. a filtration, that allows the solvent and the oxidised phenolic compounds, which may have formed a precipitate and/or haze, to be separated from the immobilised enzyme. The choice of method for separation is not critical as long as it allow to distinguish between the immobilised enzyme suspended in the solvent and the solid precipitate/haze that may have been formed by the oxidised phenolic compounds. The thus separated immobilised enzyme may be rinsed with water to remove additional oxidised phenolic compounds prior to its possible re-use. The filtrate containing the oxidised phenolic compounds which will probably be present as a fine precipitate, a haze, and/or as oxidised phenolic compounds in colloidal solution, may be further treated to separate the extract from the oxidised phenolic compounds. This may be done by means of separation such as filtration, centrifugation, ultra filtration, sedimentation etc., as already described herein.

In one embodiment, the treatment by immobilised enzymes of the tobacco extract is performed in a column comprising the immobilised enzymes by passing the tobacco extract thought said column, preferably using down-flow. To prevent blockage of the column by the possible precipitates formed, the direction of the flow may be change to up-flow with intervals to fluidize and thus rinse and remove any precipitate/haze formed. In another embodiment, the phenol oxidising enzyme-treatment of a tobacco extract in column containing immobilised enzymes is done using the principle of fluidized bed utilising the differences in particle size and density of the immobilised enzyme particles and the precipitate/haze formed to continuously treat the extract and separate the oxidised phenolic compounds forming a precipitate/haze from the enzyme.

Concentrating the Extract, Step (vi)

Optionally, the enzyme-treated extract is concentrated to a solids content of between 10–70%, such as 20–50%, typically 50% (dry matter). To this any conventional method of removing essentially only liquid, preferably in the form of water, can be used, such as reverse osmosis, ultra-filtration with low molecular weight cut-off, evaporation or freeze-concentration. However, if desirable for the process, the tobacco extract can be dried to a solid (e.g. having a solid content of 90–100%, such as 100% dry weight) by means of conventional drying processes, such as freeze-drying, spray-drying or evaporation. Optionally, first a concentration step is made by a normal procedure for concentrating liquids, followed by a drying step by normal procedures.

Combining Extract with a Tobacco Material

Preferably, any result of any of the processes described above for the treatment of the extract, is finally re-combined with the tobacco residue (step (ix)), which may or may not have been further processed or treated e.g. by drying or by extraction with an organic solvent, to provide an improved resulting tobacco product. In fact, the treated extract may be combined with any tobacco solid, but advantageously it is a tobacco solid with a low content of phenolic compounds, such as a tobacco residue resulting from an extraction process as described herein.

Thus, the enzyme treated tobacco extract may be recombined with a tobacco solid, such as the tobacco residue, typically by spraying back the extract onto the tobacco residue, but the choice of method is not critical as any method suitable for recombining extract and a tobacco solid can be used. Optionally, having recombined the tobacco solid, such as the tobacco residue, and the tobacco extract, the recombined tobacco is dried by conventional methods.

In a specific embodiment of the present invention, the treated tobacco extract is combined with a green tobacco, i.e. uncured tobacco, which may be used for tobacco chewing gum or the treated extract may be used to enrich the flavour of green tobacco by spraying tobacco extract on green tobacco leaves, see, e.g., U.S. Pat. No. 5,845,647.

Alternatively, the enzyme treated extract may be recombined with other materials, such as cigarette paper, cigarette filters, tobacco cover sheets, or any other material than the tobacco residue, which will later be combined with the tobacco residue to make up the final tobacco product. Alternatively, if the tobacco extract is dried to a solid content of e.g. 90–100%, such as 100% (dry weight) and thus essentially is to be regarded as a solid, the dried tobacco extract may be recombined with the tobacco residue or with other materials, such as cigarette paper, cigarette filters, tobacco cover sheets to make up the final enzyme treated tobacco material, by direct blending/mixing of the dried tobacco extract with the material in question, if necessary mixed with additional binders, e.g. starch, to make the dried extract stick to the material.

Proteolytic Treatment, Step (x)

In a preferred embodiment of the invention the tobacco is also treated with a proteolytic enzyme, step (x).

In one embodiment of the invention, the tobacco material is first extracted with an aqueous solvent without the presence of enzymes, whether they are phenol oxidising enzymes or proteolytic enzymes, and preferably without surfactants. The extraction mixture is separated and the aqueous extract treated with a phenol oxidising enzyme, while the residue is subjected to a further extraction with a solvent comprising a protease and optionally a surfactant. The enzymatic treated extract and residue may subsequently be combined. Accordingly, the process of the invention may comprise a step where the tobacco material or the tobacco residue has been treated with a protease before the combination with an extract treated with a phenol oxidising enzyme.

In another embodiment, the tobacco material to be treated with a phenol oxidising enzyme is a protease treated tobacco material, thus being a tobacco material with a reduced content of protein. In further embodiments of the invention, the solvent for extraction may comprise a protease.

If step (x) of proteolytic treatment is included, it is preferred that the process of the invention further comprises the step of removing the protease in order to provide a tobacco product substantially free from the protease in question. In a preferred embodiment of the invention, both a laccase and a protease are used in the preparation of a tobacco product.

The proteolytic enzyme, if used, is preferably chosen from the group comprising bacterial and fungal enzymes. Of most interest for the purpose of this invention are the enzymes used commercially in the food and detergent industries which are available at low cost. Thus, Savinase.™., Neutrase.™., Enzobake.™. or Alcalase.™. available from Novo Inc. have been found to be effective for protein removal from tobacco. The proteolytic enzymes may be added to the solution in the concentration range 0.0001%–5% w/w, such as 0.1%–5% w/w of the tobacco material.

Sequence of Steps

In preferred embodiments of the invention step (ii) is performed before any of the following steps. In a particular preferred embodiment step (ii) followed by step (iii) is performed before any of the following step.

Step (i), however, may be performed immediately after step: (ii) or e.g. following step (iii), (vii), (viii) or (vi).

Any of steps (v), (vi), (vii) or (viii) can be included in the process, in whatever sequence. They can be included once or repeated several times. They preferably always follow step (ii) and (iii), however.

In a preferred embodiment, step (vii) follows step (i). In a further preferred embodiment, step (viii) is not included. If included, step (viii) preferably follows steps (i) and (vii). In another preferred embodiment, step (v) is not included. If included, step (v) always follows step (i), and preferably also step (vii). In a still further preferred embodiment, step (vi) is the final step.

Embodiments of the process of the invention include steps

A: (ii), (iii), (i), (vii) and (vi); or

B: (ii), (iii), (i), (vii),(v) and (vi); or

C: (ii), (iii), (i), (vii), (viii), (v) and (vi); or

D: (ii), (iii), (i), (iv); or

E: (ii), (iii), (i), (iv), (vi); or

F: (ii), (i), (iv), (v), (vi); or

G: (ii), (iii), (i), (iv), (v), (vi); or

H: (ii), (iii), (i), (v), (vi)

In the Sequence Indicated.

In a particularly preferred embodiment, the process according to the invention further comprises the step of making a tobacco article for smoking.

Thus in a preferred embodiment the process of the invention includes the following steps in the sequence indicated: (ii) extracting a tobacco material with a solvent to provide an extraction mixture; (iii) separating the extraction mixture into a tobacco extract and a tobacco residue; (i) treating the extract with a phenol oxidising enzyme; (iv) separating the oxidised phenolic compound from the tobacco extract; (vi) concentrating the extract; combining the thus treated extract with the tobacco residue; and preparing a tobacco article for smoking from the combined residue and extract. In a specific embodiment, the process also comprises the step (v) of removing the enzyme, e.g., before step (vi).

According to the process of the invention, there is provided a process for preparing a tobacco product with a reduced amount of phenolic compounds, which process comprises the step of treating a tobacco material with a phenol oxidising enzyme. In particular there is provided a method for reducing the amount of phenolic compounds in a tobacco material comprising treating an extract of a tobacco material with a phenol oxidising enzyme.

The invention further relates to the use of a phenol oxidising enzyme in the treatment of a tobacco extract. A specific embodiment of the invention relates to the use of a phenol oxidising enzyme in the preparation of a tobacco product, where said phenol oxidising enzyme is not monophenol monooxygenase (EC 15 1.14.18.1).

Of particular interest is the use of a laccase in the preparation of a tobacco product. An even more preferred embodiment of the invention is the use of both a phenol oxidising enzyme, preferably a laccase, and a protease in the preparation of a tobacco product.

The present invention relates to a tobacco material obtainable, in particular obtained, by any of the processes described herein. The invention thus encompasses the final, ready-for-use tobacco products, as well as any extracts of a tobacco material having been treated by any of the processes of the invention.

Within the scope of the inveniton is a modified tobacco product having a reduced concentration of at least one phenolic compound relative to a tobacco material from which it is derived, wherein said product is produced by any of the herein described processes comprising the step of treating, i.e. contacting, a tobacco material with a phenol oxidizing enzyme.

In further aspects, the invention relates to a method for producing a tobacco product having an improved customer compliance, such as, e.g., a tobacco product according to the invention which gives the consumer an improved smoking pleasure. The invention thus relates to the use of a process according to the invention to provide a tobacco product having, e.g., a modified chemical composition, flavour, aroma, taste and/or colour.

The following examples are provided in order to further illustrate the invention but should not be construed as limiting the scope thereof.

EXAMPLES

Materials

Tobacco material: Virginia flue-cured tobacco (obtainable from Imperial Tobacco Ltd). Approx. 85% d.m. (dry matter), stored at 4° C.

Laccase: Liquid preparation of *Trametes villosa* laccase (TvL) (previously called *Polyporus pinsitus* laccase (PpL)), obtainable from Novo Nordisk A/S. The laccase can be prepared as disclosed in W096/00290 (the laccase enzyme called lacd from a strain with pDSY10). Liquid preparation of *Myceliopthora thermophila* laccase (MtL) (obtainable from Novo Nordisk A/S). All of the enzymes were in a purified form.

Standards: Scopoletin (Aldrich #24,658-1), Chlorogenic acid (Merck #820319), Rutin (Aldrich #R230-3) and Nicotine (Aldrich 24, 658-1).

Methods and Procedures:

HPLC analysis of phenolic compounds in tobacco extract and in solid tobacco (the latter via special extraction procedure as indicated under sample pre-treatment—solid tobacco):

The content of phenolic compounds is analysed by HPLC according to the procedure described below:

Liquid chromatographic system: E.g. Shimadzu SCL-6B System Controller, and two LC-6A Liquid Chromatograph (pumps) or Waters model 600 E Injector: Shimadzu SIL 6B Autoinjector or Waters 715 Ultra Wisp.

UV detector: Shimadzu SPD-6A Photodiode Array UV-VIS detector or Waters Model 481

Software: CLASS LC10/CLASS-MXA or Maxima 820

Column: Supelcosil™ LC-18 25 cm×4.6 mm (Supelco, #5-8298) or μ

Bondapack C198 stainless steel column, 30 cm×4 mm i.d., 10 μm particle size.

Guard column: none or Guard-Pak from Waters packed with the same material.

Temperature: Ambient

Mobile phase flow: 1.3 ml/min

Injection volume: 20 μl

Wavelength: 350 nm

Eluent: Binary gradient (linear) mixture of A: $KH_2PO_4$ (28.4 g in 2000 ml de-mineralised water) and B: methanol (please see table 1 and FIG. 1). The eluent is filtered through a 0.45 μm filter and degassed before use.

TABLE 1

A binary (linear) gradient profile used for the HPLC analysis of phenolic compounds.

| Minutes | T-flow | A-conc | B-conc |
|---|---|---|---|
| 0 | 1.3 | 86% | 14% |
| 17 | 1.3 | 56% | 44% |
| 30 | 1.3 | 56% | 44% |
| 31 | 1.3 | 86% | 14% |
| 35 | 1.3 | 86% | 14% |

Sample Pre-treatment for HPLC—Tobacco Extract:

Prior to HPLC analysis, the samples were filtered through a 0.45 μm filter or smaller, e.g. a sterile Sartorius Minisart 0.45 μm filter (#16555) or a Millipore Millex-GS 0.22 μm (#SBGS 0 25 SB) to remove the haze/precipitate normally formed during enzyme treatment. Normally, no dilution of the extract/sample was made before HPLC analysis.

Sample Pre-treatment for HPLC—solid Tobacco:

The tobacco is dried and sieved before analysis. The tobacco is dried at 65° C. for 15 hours and sieved through a 40–80 meshscreen. 100–200 mg tobacco is weighed accurately into a 50 ml flask with septum. 5 ml of a 1:1 mixture of water and methanol and extracted in an ultrasonic bath for 20 minutes with occasional shaking. Temperature of the water in the ultrasonic bath is checked and ice is added if necessary to keep the water at room temperature. The extraction liquor is filtered through a 0.45 μm filter or smaller and is then ready for analysis of phenolic compounds.

Standards Used in HPLC:

Scopoletin, Chlorogenic, Rutin and Nicotine.

For qualitative and semi-quantitative measurements, each of the standards was dissolved in 96% ethanol, and then mixed in a ratio and at a concentration which was within the range in the tobacco extract. For semi-quantification of the phenolic compounds in the tobacco extract, and as a measure of development in concentration of the various compounds contained in the extract, decrease in peak area relative to the peak area before addition of enzyme was used. As a measure of overall efficiency of the process, degree of reduction in total peak area of all peaks (not only the major ones) in the HPLC chromatogram with retention time Rt>3 min was used (named: "All peaks").

For quantitative measurements the following standards were made in the extracting solution: Chlorogenic acid: 20 mg/ml; Scopoletin: 1 mg/ml; Rutin: 0.75 mg/ml.

Determination of Sugars and Nicotine in Tobacco:

The reducing sugars and the nicotine content of tobacco samples and freeze-dried tobacco extracts were determined using continuous flow analysis methods similar to the CORESTA (France, Cooperation Centre for Scientific Research Relative to Tobacco) recommended methods N° 35 and N° 37. The total sugars were obtained after a hydrolysis step but the method is similar to the reducing sugars method.

Preparation of Tobacco Extract for Enzyme Treatment:

Unless otherwise indicated, the tobacco was extracted at a laboratory scale with water according to the following procedure: 1000 ml demineralised water is heated to 45° C. 30 g tobacco (approx. 25 g d.m.) is added and the mixture stirred by a magnetic bar and occasionally with a stick. After 15 minutes the tobacco residue is separated from the tobacco extract by vacuum filtration (Whatman glass micro fibre GF/F 11 cm). The filtered extract is then vacuum filtered at least once more or until it is completely clear. Yield was around 900 ml tobacco extract. The aqueous tobacco extract appeared as a red-brown liquor with a distinct smell of tobacco. pH of the tobacco extract was in the range 5.4–5.5 and it had a good buffering capacity as pH was very stable during processing and later enzyme treatment. No buffer was thus included in any of the trials. D.m. content of the extract was approximately 2.1%.

Enzyme Treatment:

Unless otherwise indicated, the enzyme treatment of the tobacco extract was performed at a laboratory scale according to the following procedure:

Tobacco extract (typically 50–100 ml) was poured into a glass beaker and a magnetic bar was added. No pH adjustments were made, and no buffer was added. The tobacco extract was heated to and controlled at 55° C. during the entire enzyme treatment by means of a heating plate and a thermostat. Intensive submerse aeration was applied by blowing atmospheric air into the extract by means of a metal sinter (metal suction filter normally used for HPLC). The enzyme in question (TvL or PpL) was added to the desired concentration. Shortly after addition of laccase, the colour of the tobacco extract turned dark brown to black, and with time the liquor became turbid and a precipitate formed. The liquor was sampled with intervals for HPLC analysis.

EXAMPLE 1

Effect of laccase on scopoletin, rutin, chlorogenic acid and nicotine

Materials

Tobacco constituents: Nicotine, Chlorogenic acid, Rutin and Scopoletin. Enzyme: Purified laccase derived from *Trametes villosa*, TvL. Apparatus: HP8452 UV/Vis diode array spectrophotometer, 1 cm quarts cuvette. Buffer: Sodium acetate (Merck)

Method 10 mM acetate buffer was prepared from sodium acetate adjusted to pH 5.0 with sulphuric acid. Stock solution of 0.50 mg/ml in 96% ethanol was prepared of nicotine, chlorogenic acid, rutin, and scopoletin. A stock solution of 0.31 mg enzyme protein/ml of laccase in de-mineralised water was prepared. The HP diode array spectrophotometer was operated as per the manufacturer's instructions. A 1 cm quartz cuvette was used. As a blank was used 950 μl buffer mixed with 50 μl 96% ethanol, In a 1 cm quart cuvette was mixed 900 μl 10 mM acetate buffer and 50 μl of the stock solution of the compound in question. A spectrum of the "native" compound was recorded in the range 190–700 nm. 50 μl of TvL stock solution was added and carefully mixed, and spectra in the range 190–700 nm were recorded every 20 seconds for 5 minutes. This resultet in the following conditions during measurement: 9 mM Na-acetate buffer pH 5.0; 4.8% Ethanol; 0.025 mg/ml of tobacco constituent; 0.016 mg/ml laccase.

Results

See FIGS. 2–5. No spectral changes (peak position and peak relative height) were observed when nicotine was treated with laccase, while significant spectral changes were observed when chlorogenic acid, rutin, and scopoletin were treated with laccase. This means that the latter compounds are substrates for laccase.

EXAMPLE 2

Laccase TvL Treatment of Tobacco Extract

Enzyme treatment: Surface aeration was used. TvL enzyme was added to the tobacco extract to a concentration of approximately 1.6 μg/ml. The HPLC analyses of the tobacco extract before, during, and after enzyme treatment showed that the phenolic compounds rutin, scopoletin, and chlorogenic acid are present in the tobacco extract in addition to various other compounds as indicated in table 2. HPLC chromatograms of the tobacco extract before, during, and after enzyme treatment as well as chromatograms of the mixture of HPLC standards are shown in FIGS. 6, 7, 8, and 9.

Furthermore a significant reduction in the number of peaks as well as in the area of the peaks have been obtained following enzyme treatment, including the phenolic compounds rutin, scopoletin, and chlorogenic acid, i.e. there is a reduction in the content of these compounds.

TABLE 2

Retention time of the 8 major peaks in the HPLC chromatogram of the aqueous tobacco extract.

| Retention time (Minutes) | Identity |
|---|---|
| 5.1 | ? |
| 6.3 | Chlorogenic acid (CA) |
| 8.5 | ? |
| 10.5 | ? |
| 13.6 | ? |
| 16.8 | Scopoletin (S) |
| 21.5 | Rutin (R) |
| 24.9 | ? |

EXAMPLE 3

Laccase TvL Treatment of Tobacco Extract at different pH

Enzyme treatment: pH of the extract was adjusted with $H_2SO_4$ or NaOH to pH 4, pH 5, pH 6, or pH 7. The extract was kept at ambient temperature (approximately 20° C.) during the entire enzyme treatment. Surface aeration was used. TvL enzyme was added to a concentration of approximately 1.6 μg/ml. Except for the tobacco extract adjusted to pH 7 the liquor became turbid and a precipitate formed with time after the addition of enzyme. The results are shown in table 3. From table 3 it is evident, that significant reduction in peak area for all peaks was obtained. From an overall point of view optimum pH at the conditions used is in the range pH 5–6.

The "natural" pH of flue-cured tobacco extract is 5.4–5.5, which thus fits very well with the optimum pH. Buffering capacity of the tobacco raw extract seemed to be quite good, as pH did not drift more than 0.1 unit in any of the trials.

Table 3.1–3: pH profile for reduction in peak area for tobacco extract treated with 1.6 μg/ml Tvl at ambient temperature and surface aeration for various periods of time in the pH range pH 4–pH7.

TABLE 3.1

% Remaining (peak area) after 0 minutes.
CA: Chlorogenic acid, R: Rutin, S: Scopoletin

| Rt time (Minutes) | ID | % Remaining (peak area) after 0 minutes. pH 4 % | pH 5 % | pH 6 % | pH 7 % |
|---|---|---|---|---|---|
| 5.1 | ? | 100 | 100 | 100 | 100 |
| 6.3 | CA | 100 | 100 | 100 | 100 |
| 8.5 | ? | 100 | 100 | 100 | 100 |
| 10.5 | ? | 100 | 100 | 100 | 100 |
| 13.6 | ? | 100 | 100 | 100 | 100 |
| 16.8 | S | 100 | 100 | 100 | 100 |
| 21.5 | R | 100 | 100 | 100 | 100 |
| 24.9 | ? | 100 | 100 | 100 | 100 |

TABLE 3.2

% Remaining (peak area) after 75 minutes.
CA: Chlorogenic acid, R: Rutin, S: Scopoletin

| Rt time (Minutes) | ID | % Remaining (peak area) after 75 minutes. pH 4 % | pH 5 % | pH 6 % | pH 7 % |
|---|---|---|---|---|---|
| 5.1 | ? | 23 | 25 | 30 | 103 |
| 6.3 | CA | 5 | 11 | 22 | 94 |
| 8.5 | ? | 7 | 16 | 29 | 100 |
| 10.5 | ? | 82 | 90 | 105 | 120 |
| 13.6 | ? | 41 | 41 | 46 | 127 |
| 16.8 | S | 89 | 94 | 96 | 100 |
| 21.5 | R | 44 | 29 | 14 | 87 |
| 24.9 | ? | 92 | 76 | 36 | 90 |

TABLE 3.3

% Remaining (peak area) after 0 minutes.
CA: Chlorogenic acid, R: Rutin, S: Scopoletin

| Rt time (Minutes) | ID | % Remaining (peak area) after 240 minutes. pH 4 % | pH 5 % | pH 6 % | pH 7 % |
|---|---|---|---|---|---|
| 5.1 | ? | 10 | 0 | 0 | 115 |
| 6.3 | CA | 0 | 0 | 0 | 85 |
| 8.5 | ? | 0 | 0 | 0 | 97 |
| 10.5 | ? | 86 | 87 | 84 | 106 |
| 13.6 | ? | 0 | 0 | 0 | 113 |
| 16.8 | S | 58 | 12 | 6 | 112 |
| 21.5 | R | 0 | 0 | 0 | 63 |
| 24.9 | ? | 58 | 10 | 0 | 69 |

EXAMPLE 4

Laccase TvL Treatment of Tobacco Extract at two Different Enzyme Concentrations and Different Processing Times Enzyme treatment: TvL enzyme was added to a concentration of approximately 1.6 μg/ml or to a concentration of approximately 7.8 μg/ml. The results are shown in table 4 and table 5. It is evident, that using a dosage of TvL of 1.6 μg/ml, a longer processing time is needed compared to using a dosage of 7.8 μg/ml to obtain the same degree of reduction of the phenolic compounds.

TABLE 4

Time profile for reduction (% remaining) in peak area for tobacco extract treated with approximately 1.6 μg/ml TvL at 55° C. and pH 5.4 using intensive, submerse aeration.
CA: Chlorogenic acid, R: Rutin, S: Scopoletin

| 1.6 μg/ml TvL | | % Remaining (peak area) after various treatment times | | | |
|---|---|---|---|---|---|
| Rt time (Minutes) | ID | 0 Min % | 40 Min % | 80 Min % | 120 Min % |
| 5.1 | ? | 100% | 28% | 0% | 0% |
| 6.3 | CA | 100% | 23% | 0% | 0% |
| 8.5 | ? | 100% | 32% | 4% | 3% |
| 10.5 | ? | 100% | 97% | 87% | 86% |
| 13.6 | ? | 100% | 53% | 0% | 0% |
| 16.8 | S | 100% | 82% | 30% | 12% |
| 21.5 | R | 100% | 20% | 0% | 0% |
| 24.9 | ? | 100% | 47% | 0% | 0% |

TABLE 4

Time profile for reduction (% remaining) in peak area for tobacco extract treated with approximately 7.8 μg/ml TvL at 55° C. and pH 5.4 using intensive, submerse aeration.
CA: Chlorogenic acid, R: Rutin, S: Scopoletin
% Remaining (peak area) after various treatment times

| Rt time (Minutes) | ID | 0 Min % | 40 Min % |
|---|---|---|---|
| 5.1 | ? | 100% | 0% |
| 6.3 | CA | 100% | 0% |
| 8.5 | ? | 100% | 0% |
| 10.5 | ? | 100% | 72% |
| 13.6 | ? | 100% | 0% |
| 16.8 | S | 100% | 3% |
| 21.5 | R | 100% | 0% |
| 24.9 | ? | 100% | 7% |

EXAMPLE 5

Laccase MUt Treatment of Tobacco Extract at Two Different enzyme Concentration and Different Processing Time Enzyme treatment: MtL enzyme was added to a concentration of approximately 0.63 μg/ml or approximately 6.3 μg/ml. The results are shown in table 6 and table 7. It is obvious, that MtL can also be used to remove the phenolic compounds. It is evident, that using a dosage of MtL of approximately 0.63 μg/ml, longer processing time is needed compared to using a dosage of 6.3 μg/ml to obtain the same degree of reduction of the phenolic compounds, and that almost complete removal can be obtained with a dosage of approximately 0.63 μg/ml.

TABLE 6

Residual amount (peak area) following treatment with approx. 0.63 μg/ml MtL at pH 5.4 and 55° C. and intensive submerse aeration for various processing times.
CA: Chlorogenic acid, R: Rutin, S: Scopoletin

| 0.63 μg/ml MtL Rt time | | % Remaining (peak area) after various treatment times | | |
|---|---|---|---|---|
| (Minutes) | ID | 0 min | 67 min | 150 min |
| 6.3 | CA | 100% | 29% | 0% |
| 8.5 | ? | 100% | 37% | 0% |
| 10.5 | ? | 100% | 83% | 77% |
| 13.6 | ? | 100% | 33% | 0% |
| 16.8 | S | 100% | 90% | 76% |
| 21.5 | R | 100% | 24% | 0% |
| 24.9 | ? | 100% | 51% | 9% |
| All peaks ($R_t$ > min) | | 100% | 36% | 5% |

TABLE 7

Residual amount (% remaining) (peak area) following treatment with approx. 6.3 μg/ml MtL at pH 5.4 and 55° C. and intensive submerse aeration for various processing times.
CA: Chlorogenic acid, R: Rutin, S: Scopoletin

| 6.3 μg/ml MtL Rt time | | % Remaining (peak area) after various treatment times | | |
|---|---|---|---|---|
| (Minutes) | ID | 0 min | 10 min | 20 min |
| 5.1 | ? | 100% | 0% | 0% |
| 6.3 | CA | 100% | 0% | 0% |
| 8.5 | ? | 100% | 0% | 0% |
| 10.5 | ? | 100% | 77% | 72% |
| 13.6 | ? | 100% | 0% | 0% |
| 16.8 | S | 100% | 78% | 52% |
| 21.5 | R | 100% | 0% | 0% |
| 24.9 | ? | 100% | 24% | 7% |
| All peaks ($R_t$ > min) | | 100% | 6% | 5% |

EXAMPLE 6

Laccase MtL Treatment of Tobacco Extract with Different Enzyme Concentrations

Enzyme treatment: MtL enzyme was added at various concentrations in the range 2.5 μg/ml–6.3 μg/ml. A fixed processing time of 20 minutes was used. After addition of laccase (but varying with the dosage applied) with time the liquor became turbid and a precipitate formed. The results are shown in table 8. It is obvious, that with increasing dosage of MtL decreasing processing time is needed to remove the phenolic compounds, and that almost complete removal can be obtained in less than 20 minutes.

TABLE 8

Residual amount (% remaining) (peak area) following treatment with various enzyme dosages for 20 minutes at pH 5.4 and 55° C. and intensive submerse aeration using MtL.
CA: Chlorogenic acid, R: Rutin, S: Scopoletin

| | | μg MtL /ml | | | |
|---|---|---|---|---|---|
| Rt | ID | 0 | 2.5 | 3.8 | 6.3 |
| 5.1 | ? | 100% | 10% | 0% | 0% |
| 6.3 | CA | 100% | 6% | 0% | 0% |

TABLE 8-continued

Residual amount (% remaining) (peak area) following treatment with various enzyme dosages for 20 minutes at pH 5.4 and 55° C. and intensive submerse aeration using MtL.
CA: Chlorogenic acid, R: Rutin, S: Scopoletin

| | | μg MtL /ml | | | |
|---|---|---|---|---|---|
| Rt | ID | 0 | 2.5 | 3.8 | 6.3 |
| 8.6 | ? | 100% | 11% | 0% | 0% |
| 10.5 | ? | 100% | 84% | 73% | 72% |
| 13.6 | ? | 100% | 10% | 0% | 0% |
| 16.8 | S | 100% | 97% | 69% | 52% |
| 21.5 | R | 100% | 5% | 0% | 0% |
| 24.9 | ? | 100% | 36% | 12% | 7% |
| All peaks ($R_t$ > 3 minutes) | | 100% | 20% | 5% | 5% |

EXAMPLE 7

Laccase Treatment of Extract at Different $pO_2$

Enzyme treatment: An oxygen electrode was immersed in the liquor, and $pO_2$ (100%=saturation with atmospheric air) measured and controlled at the desired level by blowing atmospheric air and/or $N_2$ into the extract by means of a metal sinter (metal suction filter normally used for HPLC). MtL enzyme was added at a concentration of approximately 3.8 μg/ml. A fixed processing time of 20 minutes was used. After (but depending on the level of $pO_2$) addition of laccase with time the liquor became turbid and a precipitate formed. The results are shown in table 9. It is evident, that at the conditions used, efficiency increases with increasing $pO_2$. At the conditions used oxygen is rate limiting if $pO_2$<90%.

TABLE 9

Residual amount (% remaining) (peak area) following treatment with 3.8 μg/ml for 20 minutes at pH 5.4 and 55° C. at various levels of $pO_2$.
CA: Chlorogenic acid, R: Rutin, S: Scopoletin

| | | % pO2 | | | |
|---|---|---|---|---|---|
| Rt | ID | 0 | 30 | 50 | 90 |
| 5.1 | ? | 100% | 25% | 2% | 0% |
| 6.3 | CA | 100% | 20% | 1% | 0% |
| 8.6 | ? | 100% | 27% | 0% | 0% |
| 10.5 | ? | 100% | 78% | 74% | 74% |
| 13.6 | ? | 100% | 53% | 0% | 0% |
| 16.8 | S | 100% | 75% | 59% | 45% |
| 21.5 | R | 100% | 17% | 1% | 0% |
| 24.9 | ? | 100% | 50% | 25% | 10% |
| All peaks ($R_t$ > 3 minutes) | | 100% | 28% | 7% | 5% |

EXAMPLE 8

Laccase and Bentonite Treatment of Tobacco

Centrifugation: Beckman J-6B centrifuge equipped with JS-4.2 rotor. 1 Litre containers were used. Operated at 4200 rpm (approximately 5000×g) for 10 minutes at room temperature. Freeze drying: Heto SICC CD 40. The extracts were frozen at −45° C., and temperature gradually increased to 20° C. during drying at 3 mbar.

Figure 10:
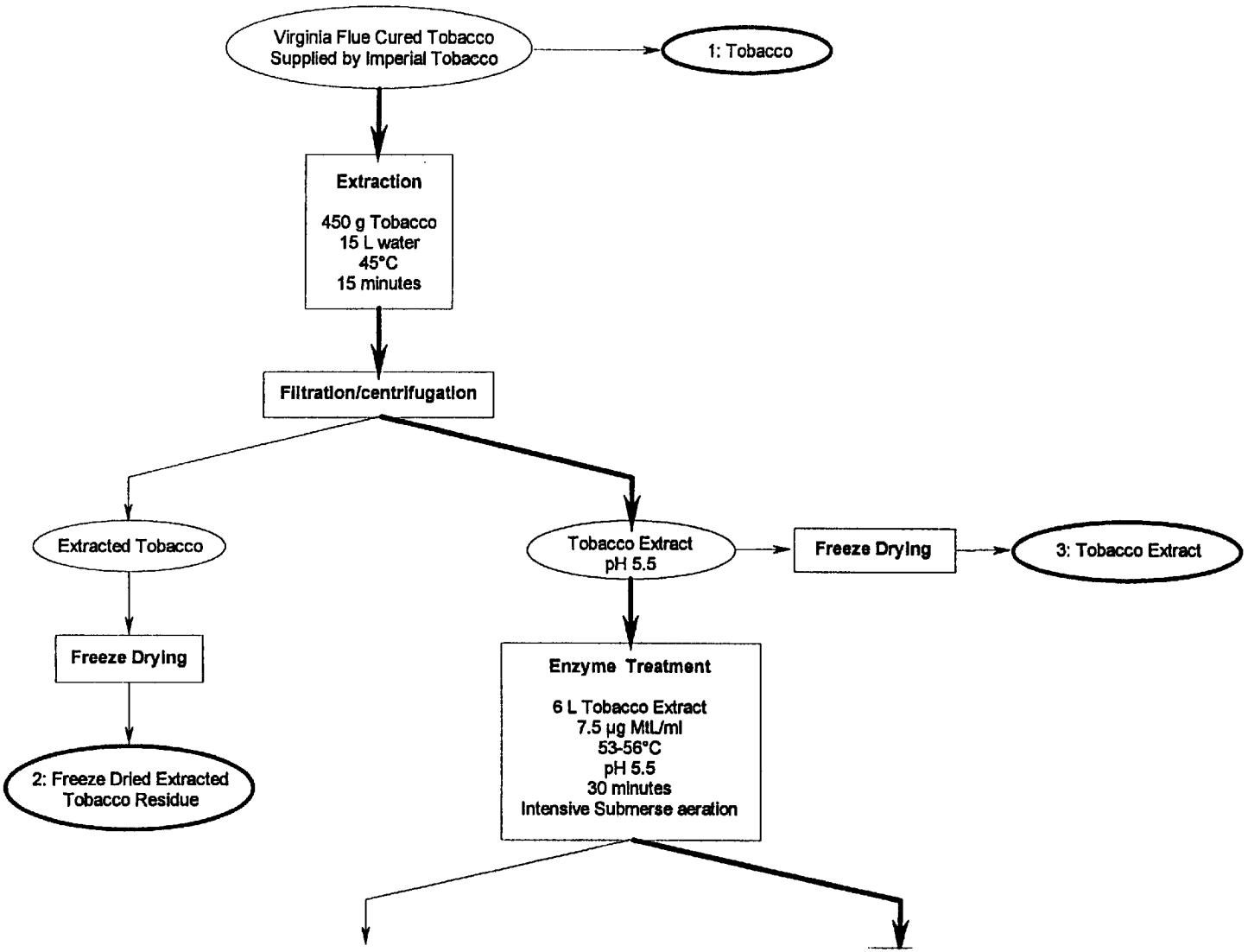
FIG. 10: Flow chart showing process-flow and indicating which samples have been prepared, see Example 8.
Figure 10:
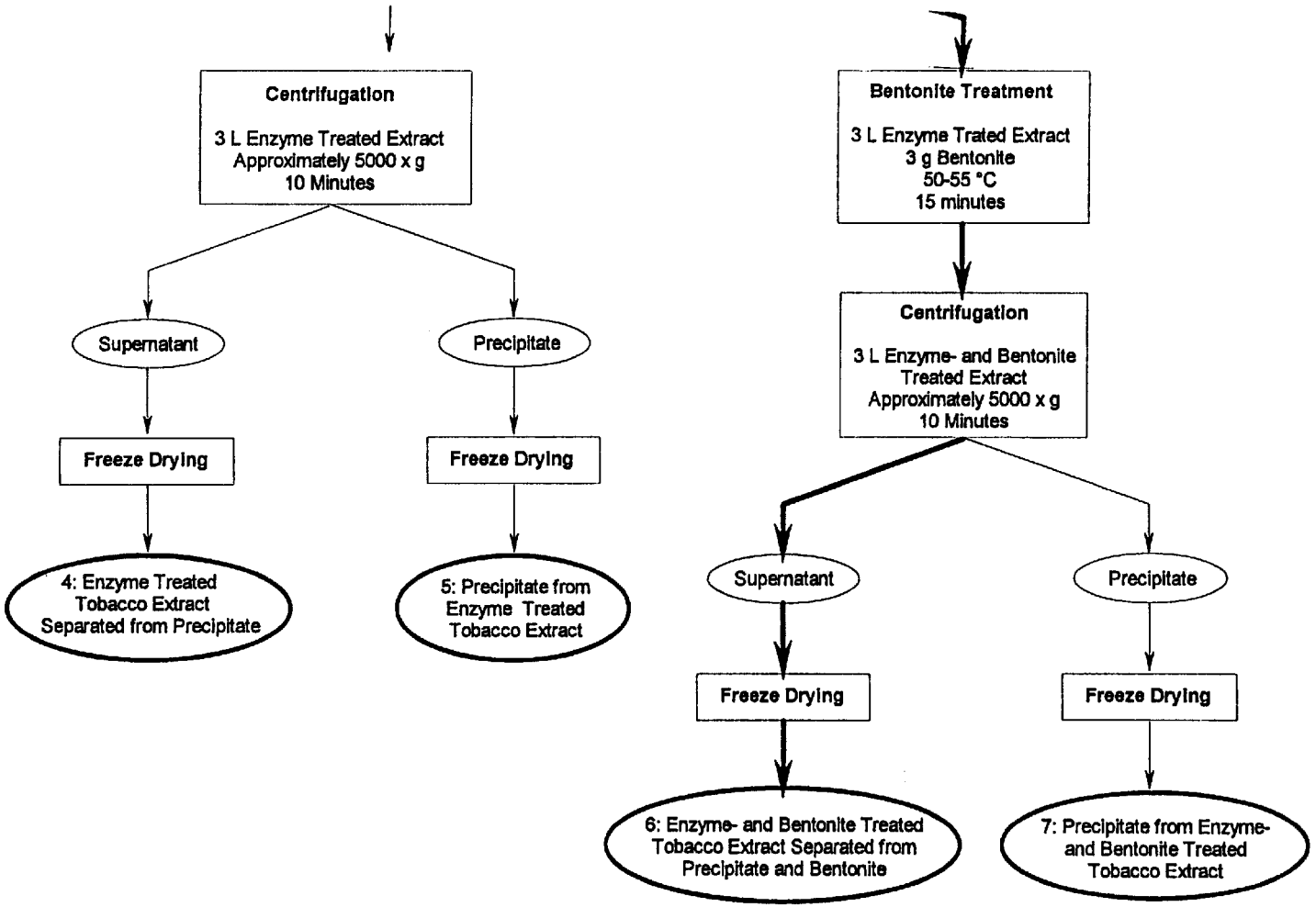

Procedure: A flow chart showing which samples have been prepared is shown in FIG. 10.

Extraction of Tobacco:

The tobacco was extracted at a laboratory scale with water according to the following procedure: 15 Litres de-mineralised water is heated to 45–46° C. 450 g tobacco (approx. 390 g d.m.) is added and the mixture is stirred manually with a stick. After 15 minutes the tobacco residue is separated from the aqueous tobacco extract by vacuum filtration. The tobacco residue was freeze dried and labelled "2: Freeze Dried Extracted Tobacco Residue".

The tobacco extract was centrifuged for 10 min at approx. 5000×g to remove suspended particles/haze. Yield was around 13.5 Litres. The aqueous tobacco extract appeared as a red-brown liquor with a distinct smell of tobacco. pH of the tobacco extract was 5.5 and apparently it had quite a good buffering capacity as pH was very stable during processing and later enzyme treatment. No pH adjustment was made prior to enzyme processing, and no buffer was added. D.m. content of tobacco extract was approximately 1.4% (approximately 10 g tobacco extract dried at 120° C. until constant weight for at least 120 s). A sample of the tobacco extract was analysed by means of HPLC. 1.5 L of the tobacco extract was freeze dried and labelled "3: Tobacco Extract".

Enzyme Treatment:

6 L tobacco extract was heated to and controlled at 53–56° C. by means of a heating plate and a thermostat. Atmospheric air was blown into the liquor through a silicone tube (12 mm diameter) which had been perforated with a needle to create numerous small wholes. Aeration was sufficiently intense that no further mixing was needed as the air blown into the liquor lead to efficient mixing. MtL was added to a final concentration of approximately 7.5 μg/ml. After 30 minutes, a sample was collected and analysed by means of HPLC.

After 30 minutes 3 L of the "enzyme treated tobacco extract" was centrifuged for 10 minutes at approx. 5000×g. The supernatant was collected by decanting and was completely clear. A sample was analysed by means of HPLC. D.m. content was approximately 1.5% (approximately 10 g extract dried at 120° C. until constant weight for at least 120 s). The supernatant was freeze dried and labelled "4: Enzyme Treated Tobacco Extract Separated from Precipitate".

The "precipitate from enzyme treated tobacco extract" (solid material containing a little extract) was suspended in demineralised water and collected from the containers and freeze dried and labelled 5: Precipitate From Enzyme Treated Tobacco Extract.

Bentonite Treatment:

The remaining 3 L of the 6 L "enzyme treated extract" was treated with bentonite (Aldrich #28,523–4): 3 g bentonite was suspended in approx. 200 ml "enzyme treated extract". The extract/bentonite slurry was recombined with the remaining enzyme treated extract and incubated at 50–55° C. for 15 minutes during stirring. After 15 minutes, a sample was analysed by means of HPLC.

After 15 minutes the enzyme treated and bentonite treated extract was centrifuged for 10 minutes at approximately 5000×g. The supernatant was collected by decanting and was completely clear. A sample of the supernatant was analysed by means of HPLC. D.m. content of the supernatant was approximately 1.5% (approximately 10 g extract dried at 120° C. until constant weight for at least 120 s). The supernatant was freeze dried and labelled "6: Enzyme- and Bentonite Treated Tobacco Extract Separated from Precipitate and Bentonite".

The precipitate (solid material containing enzyme generated precipitate as well as bentonite and a little extract) was suspended in de-mineralised water and collected from the containers, freeze dried, and labelled "7: Precipitate from Enzyme- and Bentonite Treated Tobacco Extract".

In table 10 the results from the HPLC analysis of phenolic compounds of the various extracts is shown.

Table 11 shows the results from the Auto Analyzer analysis of reducing sugars and total sugars as well as of nicotine of the various solid tobacco fractions.

In table 12 the results from the Auto Analyzer analysis of reducing sugars and total sugars as well an of nicotine of the various tobacco extracts and fractions thereof is shown.

It is evident, that a very high degree of removal of phenolic compounds from the tobacco extract has been obtained. Further, it is evident, that the majority of reducing sugars, total sugars and nicotine is extracted form the tobacco by the extraction procedure and thus occurs in the tobacco extract. However, none of these compounds are significantly affected by the enzyme treatment and/or bentonite treatment of the extract, and are thus kept intact in the treated extract and can thus be transferred back to the tobacco when recombined.

TABLE 10

Remaining content (% remaining) (measured as peak area relative to the content in the extract) of the major peaks in the HPLC chromatograms as well as of all peaks with $R_t$ > 3 minutes.

| Rt Min | ID | Sample 3 tobacco extract before enzyme treatment | Sample 4 (1) enzyme treated extract after separation from precipitate | Sample 6 (1) enzyme and bentonite treated extract separated from precipitate and bentonite |
|---|---|---|---|---|
| 5.1 | ? | 100% | 0% | 0% |
| 6.3 | CA | 100% | 0% | 0% |
| 8.5 | ? | 100% | 0% | 0% |
| 10.5 | ? | 100% | 61% | 50% |
| 13.6 | ? | 100% | 0% | 0% |
| 16.8 | S | 100% | 47% | 44% |
| 21.5 | R | 100% | 0% | 0% |
| 24.9 | ? | 100% | 0% | 0% |
| peaks $R_t$ > 3 min | | 100% | 4% | 3% |

(1) Before drying
CA: Chlorogenic acid, R: Rutin, S: Scopoletin

TABLE 11

Content of reducing sugars, total sugars, and nicotine in "tobacco"/"tobacco residue". All figures are % (w/w) and have been determined relative to 100% dry matter.

| | 1: Raw tobacco before extraction | 2: Freeze dried extracted tobacco ("tobacco residue") |
|---|---|---|
| R.S. | 13.8% | 2.3% |
| T.S. | 17.2% | 2.6% |
| Nicotine | 2.74% | 0.48% |

R.S: Reducing sugars, T.S: Total sugars

TABLE 12

Content of reducing sugars, total sugars, and nicotine in the "tobacco extract" as well as in the various fractions of enzyme treated tobacco extract. All figures are % (w/w) and have been determined relative to 100% dry matter.

| | R.S. | T.S. | Nicotine |
|---|---|---|---|
| Sample 3 | 23.5% | 29.0% | 4.95% |
| tobacco extract before enzyme treatment | | | |
| Sample 4 | 24.6% | 28.5% | 4.59% |
| enzyme treated extract after separation from precipitate | | | |
| Sample 5 | 2.4% | 2.8% | 0.68% |
| precipitate from enzyme treated extract | | | |
| Sample 6 | 25.0% | 28.6% | 4.32% |
| enzyme and bentonite treated extract separated from precipitate and bentonite | | | |
| Sample 7 | 2.4% | 2.7% | 0.70% |
| precipitate from enzyme and bentonite treated tobacco | | | |

R.S: Reducing sugars, T.S: Total sugars.

EXAMPLE 9

Large Scale Tobacco Processing 3.0 kg of tobacco (flue-cured Virginia tobacco, cut at 35 cuts per inch (cpi)) were extracted in 100 litres of water at 60–65° C. for 15 minutes. The extract was separated from the "tobacco residue" and collected in a large tank. The temperature of the extract was 55° C. and slowly dropped to 40° C. during processing. MtL was added to a final concentration of 4.1 μg/ml. The mixture was intensely aerated during the reaction time. Samples were collected at intervals and analysed for chlorogenic acid (CA), rutin (R) and scopoletin (S) by means of HPLC. A portion of each sample was freeze dried and the solid residue was analysed for sugars and nicotine by means of an Auto Analyzer. The results are shown in table 13.

The same analyses as made on the tobacco extract were also performed on the tobacco before and after the water extraction. The results are shown in table 14.

It is evident, that the phenol content of the tobacco extract was reduced to a minimum after 20 minutes processing. Further, it is evident, that the majority of reducing sugars and total sugars and nicotine is extracted from the tobacco by the extraction procedure and thus occurs in the tobacco extract. However, none of these compounds are significantly affected by the enzyme treatment of the extract, and are thus kept intact in the "enzyme treated tobacco extract" and can be transferred back to the tobacco residue when recombined.

The experiment was repeated with 6.0 kg tobacco and 200 litres of water at 60–65° C. Similar results were obtained with the 200 litre batch as with the 100 litre batch. The results are presented in table 15 and table 16.

TABLE 13

Content of various tobacco extract components as a function of time during MtL treatment during the 3.0 kg/100 liter scale treatment.

| Time min | Temp 0° C. | [CA] mg/ml | [R] mg/ml | [S] mg/ml | R.S. % w/w | Nic. % w/w | T.S. % w/w |
|---|---|---|---|---|---|---|---|
| 0(1) | 54.9 | 0.420 | 0.1490 | 0.0087 | 22.0 | 4.94 | 24.3 |
| 5 | 52.0 | 0.036 | 0.0198 | 0.0063 | 22.1 | 4.41 | 24.2 |
| 10 | 50.3 | BDL | 0.0020 | 0.0027 | 22.4 | 4.38 | 24.2 |
| 15 | 48.8 | BDL | BDL | 0.0014 | 22.7 | 4.43 | 24.5 |
| 20 | 47.4 | BDL | BDL | 0.0010 | 23.2 | 4.49 | 24.3 |
| 30 | 45.0 | BDL | BDL | 0.0010 | 23.5 | 4.48 | 24.5 |
| 45 | 41.9 | BDL | BDL | 0.0010 | 23.3 | 4.48 | 24.6 |
| 60 | 39.1 | BDL. | BDL | 0.0010 | 23.7 | 4.54 | 24.8 |

(1): Before laccase addition.
CA: Chlorogenic acid, R: Rutin, S: Scopoletin
Detection limit: CA: 2.43 pg/ml; R: 1.55 pg/ml; S: 0.50 pg/ml
BDL: Below detection limit,
R.S. Reducing sugars, Nic: Nicotine, T.S.: Total sugars
%R.S., %Nic., %T.S. were measured on freeze dried extracts

TABLE 14

Content of various tobacco components in tobacco before ("raw tobacco") and after extraction ("tobacco residue") during the 3.0 kg/100 liter scale treatment.

| ID | DWB kg | [CA] % w/w | [R] % w/w | [S] % w/w | R.S. % w/w | Nic. % w/w | T.S. % w/w |
|---|---|---|---|---|---|---|---|
| Virginia tobacco ("raw tobacco") | 2.580 | 1.986 | 0.761 | 0.045 | 18.8 | 3.00 | 17.2 |
| Extracted Virginia tobacco ("tobacco residue") | 1.109 | 0.223 | 0.147 | 0.013 | 1.8 | 0.43 | 2.2 |

DWB: Tobacco Dry Weight Basis
CA: Chlorogenic acid, R: Rutin, S: Scopoletin
Detection limit: CA: 0.008%; R: 0.005%; S: 0.002%
R.S. Reducing sugars, Nic: Nicotine, T.S.: Total sugars

TABLE 15

Content of various tobacco extract components as a function of time during MtL treatment during the 6.0 kg/200 liter scale treatment.

| Time min | Temp 0° C. | [CA] mg/ml | [R] mg/ml | [S] mg/ml | R.S. % w/w | Nic. % w/w | T.S. % w/w |
|---|---|---|---|---|---|---|---|
| 0(1) | 57.2 | 0.4350 | 0.1448 | 0.0111 | 23.5 | 5.19 | 26.0 |
| 5 | 56.2 | 0.()166 | 0.0109 | 0.0101 | 23.7 | 4.77 | 25.3 |
| 10 | 55.8 | 0.0138 | 0.0111 | 0.0090 | 23.4 | 4.68 | 24.7 |
| 15 | 55.2 | BDL | BDL | 0.0078 | 23.6 | 4.67 | 25.2 |
| 20 | 54.5 | BDL | BDL | 0.0054 | 24.1 | 4.74 | 25.5 |
| 30 | 53.5 | BDL | BDL | 0.0043 | 23.9 | 4.69 | 25.5 |
| 45 | 52.2 | BDL | BDL | 0.0020 | 24.5 | 4.72 | 25.4 |
| 60 | 51.0 | BDL | BDL | 0.0019 | 24.3 | 4.76 | 25.9 |

(1): Before laccase addition.
CA: Chlorogenic acid, R: Rutin, S: Scopoletin
Detection limit: CA: 2.43 pg/ml; R: 1.55 pg/ml; S: 0.50 pg/ml
BDL: Below detection limit
R.S. Reducing sugars, Nic: Nicotine, T.S.: Total sugars
%R.S., %Nic., %T.S. were measured on freeze dried extracts

TABLE 16

Content of various tobacco components in tobacco before ("raw tobacco) and after extraction ("tobacco residue") during the 6.0 kg/200 liter scale treatment.

| ID | DWB kg | [CA] % w/w | [R] % w/w | [S] % w/w | R.S. % w/w | Nic. % w/w | T.S. % w/w |
|---|---|---|---|---|---|---|---|
| Virginia tobacco ("raw tobacco") | 5.160 | 1.777 | 0.675 | 0.040 | 2.96 | 3.00 | 16.2 |
| Extracted Virginia tobacco ("tobacco residue") | 2.307 | 0.243 | 0.150 | 0.014 | 1.9 | 0.47 | 2.2 |

DWB: Tobacco Dry Weight Basis
CA: Chlorogenic acid, R: Rutin, S: Scopoletin
Detection limit: CA: 0.008%; R: 0.005%; S: 0.002%
R.S. Reducing sugars, Nic: Nicotine, T.S.: Total sugars

EXAMPLE 10

"Raw tobacco" was extracted according to the procedure described in Example 8. The "tobacco extract" was treated with MtL for 20 minutes at 55° C. with intense aeration and at a concentration of MtL corresponding to 4.1 μg/ml. After enzyme treatment, bentonite was added at a concentration of 1 g/L at the temperature of the extract after the laccase treatment (50° C.) for 10 minutes. The slurry was clarified at a flow rate of 1 L/min using a continuous centrifuge. The enzyme treated and clarified extract was then concentrated 40 fold by means of reverse osmosis and evaporation. The concentrate was then recombined with the "tobacco residue" by spraying back the extract onto the tobacco residue, and finally dried, resulting in "recombined tobacco material".

Samples of tobacco before and after extraction and recombination with the tobacco extract was analysed for nicotine, reducing sugars, total sugars by means of an Auto Analyzer according to the method previously described, and analysed for chlorogenic acid, rutin, and scopoletin by means of HPLC according the method previously described. The tobacco extract before and after MtL and bentonite treatment was analysed for chlorogenic acid, rutin, and scopoletin by means of HPLC according the method previously described. The results obtained are shown in table 17 and 18.

It is evident that the amount of phenolic compounds in the recombined tobacco material has been significantly reduced compared to the raw tobacco. Further, it is evident that the reducing sugar as well as the total sugar content has not been affected, and that the nicotine content is only slightly reduced.

TABLE 17

Analysis of phenolic compound content of tobacco extract before and after enzyme- and bentonite treatment.

| Sample | [CA] mg/ml | [R] mg/ml | [S] mg/ml |
|---|---|---|---|
| Intact extract ("tobacco extract") | 0.464 | 0.0995 | 0.0066 |
| Extract after MtL treatment | BDL | 0.005 | 0.0047 |
| Extract after MtL- and bentonite treatment and separation by centrifugation | BDL | BDL | 0.0017 |

CA: Chlorogenic acid, R: Rutin, S: Scopoletin
Detection limit: CA: 2.43 pg/ml; R: 1.55 pg/ml; S: 0.50 pg/ml
BDL: Below detection limit

TABLE 18

Content of various tobacco components in tobacco before and after extraction and recombination with the enzyme- and bentonite treated extract.

| ID | [CA] % w/w | [R] % w/w | [S] % w/w | R.S. % w/w | Nic. % w/w | T.S. % w/w | Σphenol % w/w |
|---|---|---|---|---|---|---|---|
| $X_1$ | 1.662 | 0.665 | 0.045 | 12.9 | 3.27 | 14.9 | 2.592 |
| $X_2$ | BDL | BDL | 0.006 | 14.6 | 2.40 | 14.0 | 0.006 |

$X_1$: Untreated virginia tobacco("raw tobacco")
$X_2$: Virginia tobacco recombined with treated extract ("recombined tobacco")
CA: Chlorogenic acid, R: Rutin, S: Scopoletin
Detection limit: CA: 0.008%; R: 0.005%; S: 0.002%
BDL: Below Detection Limit
R.S. Reducing sugars, Nic: Nicotine, T.S.: Total sugars

What is claimed is:

1. A process for preparing a tobacco product, which comprises the steps of (i) extracting a tobacco material with a solvent to provide an extraction mixture;

(ii) separating the extraction mixture into a tobacco extract and a tobacco residue, and (iii) contacting the tobacco extract with a phenol oxidising enzyme to produce one or more oxidised phenolic compounds.

2. The process according to claim 1, further comprising the step of (iv) separating the oxidised phenolic compound (s) from the tobacco extract.

3. The process according to claim 2, wherein said separation is achieved by means of centrifugation, filtration, ultrafiltration, sedimentation, reverse osmosis, sedimentation, adsorption, decanting or sieving, or any combinations of the foregoing.

4. The process according to claim 1, further comprising the step of inactivating and/or removing the phenol oxidising enzyme.

5. The process according to claim 1, further comprising the step of concentrating the extract.

6. The process according to claim 1, further comprising:

treating the extract with an insoluble adsorbent; and/or treating the extract with polyvinylpolypyrrolidone (PVPP).

7. The process according to claim 3, which comprises the following steps in the sequence indicated:

(i) extracting a tobacco material with a solvent to provide an extraction mixture;

(ii) separating the extraction mixture into a tobacco extract and a tobacco residue;

(iii) contacting the extract with a phenol oxidising enzyme;

(iv) contacting the extract with an insoluble adsorbent; and (v) concentrating the extract.

8. The process according to claim 1, which comprises the following steps in the sequence indicated:

(i) extracting a tobacco material with a solvent to provide an extraction mixture;

(ii) separating the extraction mixture into a tobacco extract and a tobacco residue;

(iii) contacting the extract with a phenol oxidising enzyme to produce one or more oxidised phenolic compound;

(iv) separating the oxidised phenolic compound(s) from the tobacco extract; and (v) concentrating the extract.

9. The process according to claim 1, further comprising the step of combining the enzyme-treated tobacco extract with a tobacco material.

10. The process according to claim 9, wherein a tobacco material has been treated with a protease before the combination with the extract.

11. The process according to claim 1, further comprising the step of recombining the enzyme-treated tobacco extract with the tobacco residue.

12. The process according to claim 1, further comprising the step of treatment with a proteolytic enzyme.

13. The process according to claim 1, wherein the tobacco product is a tobacco article for smoking.

14. The process according to claim 1, wherein the solvent is an aqueous solvent.

15. The process according to claim 14, wherein the solvent comprises a protease.

16. The process according to claim 1, wherein the solvent comprises a surfactant.

17. The process according to claim 1, wherein the phenol oxidising enzyme is a phenolic oxidase.

18. The process according to claim 17, wherein the phenolic oxidase is selected from the group consisting of a catechol oxidase, a laccase and an o-aminophenol oxidase.

19. The process according to claim 18, wherein the phenolic oxidase is a laccase.

20. The process according to claim 19, wherein the laccase is derived from a species selected from the group consisting of Trametes, Myceliophthora, Coprinus, Rhizoctonia, Pycnoporus, and tobacco species.

21. The process according to any of claim 1, wherein the phenol oxidising enzyme is a peroxidase.

22. The process according to claim 21, wherein the peroxidase is a horseradish peroxidase, a soy bean peroxidase, a tobacco peroxidase or a peroxidase derived from Coprinus, Bacillus, or Myxococcus.

23. The process according to claim 1, wherein the phenol oxidising enzyme reacts with its substrate by single electron transfer.

24. The process according to claim 1, wherein the phenol oxidising enzyme is derived from tobacco.

25. The process according to claim 1, wherein said tobacco product resulting from said process has a reduced concentration of phenolic compounds of at least 5% compared to an untreated tobacco material.

26. The process according to claim 25, wherein said phenolic compound is selected from the group consisting of chlorogenic acid, rutin, and scopoletin.

27. The process according to claim 1, wherein said tobacco product resulting from said process has a reduced concentration of phenolic compounds of at least 30% compared to an untreated tobacco material.

28. The process according to claim 1, wherein the phenolic oxidizing enzyme is derived from a microorganism.

29. A process for preparing a tobacco product with a reduced concentration of at least one phenolic compound, which process comprises the steps of:

(i) treating a tobacco material with a phenol oxidising enzyme; and (ii) separating the oxidised phenolic compound(s) from the tobacco material.

30. The process according to claim 29, wherein the phenol oxidizing enzyme is a laccase.

31. A process for reducing the concentration of at least one phenolic compound in a tobacco material comprising contacting an extract of a tobacco material with a phenol oxidising enzyme.

32. A process for reducing the concentration of at least one phenolic compound in a tobacco material according to claim 31 wherein said phenolic compound(s) is/are low molecular weight phenolic compound(s).

33. A process for reducing the concentration of at least one phenolic compound in a tobacco material comprising contacting an extract of a tobacco material with a phenol modifying enzyme.

* * * * *